US010358920B2

(12) United States Patent
Seo et al.

(10) Patent No.: US 10,358,920 B2
(45) Date of Patent: Jul. 23, 2019

(54) TUNNEL CONSTRUCTION METHOD USING PRE-SUPPORT AND POST-SUPPORT AND APPARATUS SUITABLE FOR SAME

(71) Applicants: HYUN ENGINEERING AND CONSTRUCTION CO., LTD; Dong-hyun Seo, Seoul (KR); Min-kyu Seo, Seoul (KR)

(72) Inventors: Dong-hyun Seo, Seoul (KR); Min-kyu Seo, Seoul (KR)

( * ) Notice: Subject to any disclaimer, the term of this patent is extended or adjusted under 35 U.S.C. 154(b) by 0 days.

(21) Appl. No.: 15/748,127

(22) PCT Filed: Nov. 23, 2016

(86) PCT No.: PCT/KR2016/013542
§ 371 (c)(1),
(2) Date: Jan. 26, 2018

(87) PCT Pub. No.: WO2017/090975
PCT Pub. Date: Jun. 1, 2017

(65) Prior Publication Data

US 2018/0252104 A1 Sep. 6, 2018

(30) Foreign Application Priority Data

Nov. 25, 2015 (KR) ..... 10-2015-0165207

(51) Int. Cl.
*E21D 9/01* (2006.01)
*E21D 9/00* (2006.01)
(Continued)

(52) U.S. Cl.
CPC ..... *E21D 9/01* (2016.01); *E21D 9/00* (2013.01); *E21D 11/00* (2013.01); *E21D 11/10* (2013.01);
(Continued)

(58) Field of Classification Search
CPC ..... E21D 20/02; E21D 13/00; E21D 9/00; E21D 11/00
See application file for complete search history.

(56) References Cited

U.S. PATENT DOCUMENTS 4,340,254 A * 7/1982 Barsi ..... E21F 15/00 299/11
7,717,998 B2 * 5/2010 Kanazawa ..... C04B 7/21 106/696

FOREIGN PATENT DOCUMENTS

JP 08-170484 A 7/1996
JP 09-096194 A 4/1997
(Continued)

*Primary Examiner* — Sean D Andrish

(57) ABSTRACT

The present invention relates to a tunneling method, and particularly, to a tunneling method by installing an internal pre-support member and a corresponding post support member in an alternate manner or by installing an external pre-support member and a corresponding post support member in an alternate manner, and an apparatus, respectively, therefor. The tunneling method includes: excavating a pilot tunnel in a main tunnel to be constructed; radially forming a drilled hole from an excavation surface of the pilot tunnel to a tip end of the pre-support member of the main tunnel at a plurality of locations in the pilot tunnel to install the pre-support member; inserting the pre-support member into the drilled hole, and conducting grouting and performing curing to fix the pre-support member; excavating the tunnel in stages in a longitudinal direction along an excavation line of the main tunnel and primarily spraying shotcrete to an excavation surface of the main tunnel in the main tunnel; installing a post-support member between a plurality of the pre-support members on the main tunnel surface to which the shotcrete is primarily sprayed; and connecting the pre-support member and the post-support member with a plate type support member.

13 Claims, 17 Drawing Sheets

(51) Int. Cl.

| | |
|---|---|
| ***E21D 11/00*** | (2006.01) |
| ***E21D 11/10*** | (2006.01) |
| ***E21D 13/00*** | (2006.01) |
| ***E21D 20/02*** | (2006.01) |
| ***E21D 11/12*** | (2006.01) |

(52) U.S. Cl.
CPC ..... *E21D 11/12* (2013.01); *E21D 13/00* (2013.01); *E21D 20/02* (2013.01)

(56) References Cited

FOREIGN PATENT DOCUMENTS

| | | | | |
|---|---|---|---|---|
| JP | 2011052536 | | * | 3/2011 |
| KR | 10-2006-0059833 | | | 6/2007 |
| KR | 10-1066641 | B1 | | 1/2011 |
| KR | 10-1247702 | B1 | | 1/2012 |
| WO | WO 2014182074 | | * | 11/2014 |

* cited by examiner

TUNNEL CONSTRUCTION METHOD USING PRE-SUPPORT AND POST-SUPPORT AND APPARATUS SUITABLE FOR SAME

BACKGROUND

1. Field

The present invention relates to a tunneling method, and more particularly, to a tunneling method of installing both of an internal pre-support member or an external pre-support member, and a post support member, and an apparatus therefor.

2. Description of Related Art

Generally, a tunnel is structurally unsound if the original ground is soft or a width of the tunnel is wide. In an existing NATM (New Austrian Tunneling Method) as one of various methods for overcoming the problem, multi-stage sequential excavation is performed, and support installation is performed in every stage of sequential excavation.

In such a method, since a process is complicated and the tunnel is in an unsupported state from the beginning of excavation, a risk of collapse of the tunnel, thus it can be said that it is a very dangerous method in terms of safety.

In order to increase an arching area in a large-section tunnel having a very large cross section, both of an anchor bolt made of a long steel wire and a short rock bolt have been installed, but since there was no pre-support concept, an auxiliary method for overcoming the unsupported state at the time of excavation was needed.

As a method for overcoming the problem, a technique relating to an external pre-support tunnel in which when a soil cover depth is thin, an external pre-support member is first installed toward the tunnel from a ground surface and a main tunnel is excavated, and a pilot tunnel is first excavated in a main tunnel, internal pre-support members are installed at a plurality of locations in the pilot tunnel, and then the main tunnel is excavated up to an excavation line, have been developed.

The method is advantageous in that the tunnel is not in the unsupported state, and after the pre-support, the excavation may be performed so that one-time excavation length is long at the tunnel face. However, in the case of the external pre-support, when the soil cover depth is thick, a drilling length is long, as a result, construction cost increases, and it is difficult to appropriately perform reinforcement from the ground surface in response to change of a ground layer according to a thickness of a soil layer. In the case of the internal pre-support method, holes are drilled in the original ground of the pilot tunnel through a planned excavation surface of the main tunnel toward an excavation surface of the tunnel in a length required for stabilizing the tunnel by using a drill capable of drilling a long hole at the excavation surface of the pilot tunnel, and the pre-support member needs to be pushed into the drilled hole of the original ground of the main tunnel to be fixed and installed. Therefore, in a ultra large-section tunnel, a length of the hole for installing the pre-support member is long, the number thereof is large, and the holes need to be densely drilled at the excavation surface of the pilot tunnel, thus the original ground of the pilot tunnel close to the excavation surface of the pilot tunnel is excessively damaged, such that stability of the pilot tunnel deteriorates, and it is uneconomical in terms of cost.

As a method for solving the above described problem, when installing the external pre-support members, a method of installing a minimum number of external pre-support members, and appropriately installing support members after checking the ground of the excavation surface in the tunnel as partial reinforcement may be used, and when installing the internal pre-support members, a method of minimizing the number of internal pre-support members and additionally installing support members at the excavation surface of the main tunnel may be used, since the holes drilled from the pilot tunnel to the main tunnel disappear, through such methods, safety of the pilot tunnel may be secured, processes may be reduced, and a more economical tunnel may be made.

SUMMARY

An object of the present invention is to provide a tunneling method using a pre-support member and a post-support member, capable of securing structural economical efficiency by installing support members while effectively distributing stress increased as approaching an excavation surface of a main tunnel by installing a plurality of pre-support members after excavating the main tunnel and additionally installing post-support members between the plurality of pre-support members, and providing economical effects by decreasing the number of pre-support members of which installation cost is expensive, and an apparatus therefor.

According to an aspect of the present invention, a tunneling method using an internal pre-support member and a post-support member includes: excavating a pilot tunnel in a main tunnel to be constructed; radially forming a drilled hole from an excavation surface of the pilot tunnel to a tip end of the internal pre-support member of the main tunnel at a plurality of locations in the pilot tunnel to install the internal pre-support member; inserting the internal pre-support member into the drilled hole, and conducting grouting and performing curing to fix the internal pre-support member; excavating the pilot tunnel in stages in a longitudinal direction along an excavation line of the main tunnel and primarily spraying shotcrete to an excavation surface of the main tunnel in the main tunnel; installing a post-support member between a plurality of the internal pre-support members on the excavation surface of the main tunnel to which the shotcrete is primarily sprayed; and connecting the internal pre-support member and the post-support member with a plate type support member.

In the installing of the post-support member between the plurality of internal pre-support members in the excavation surface of the main tunnel to which the shotcrete is primarily sprayed, the post-support member may be installed between the internal pre-support members in a ceiling part 17 of the main tunnel, and in side wall parts 18 of the main tunnel, only the post-support member may be installed.

The tunneling method may further include: eccentrically disposing and excavating the pilot tunnel in the main tunnel so that a planned excavation surface of the main tunnel and the excavation surface of the pilot tunnel are spaced apart from each other as much as possible and performing a support process to secure structural safety; installing the internal pre-support member in the original ground of the main tunnel from the pilot tunnel that is eccentrically installed; and installing the post-support member between the plurality of internal pre-support members in the excavation surface of the main tunnel to which the shotcrete is primarily sprayed after excavating the main tunnel.

In inserting and installing the internal pre-support member in the drilled hole, the internal pre-support member may be mounted with a stopper for preventing slip in the drilled hole, a discharge hose and an injection hose may be bound to a side surface of the internal pre-support member, a packer for pressurized-grouting may be mounted at a tip end of the internal pre-support member of the inner side of the tunnel, the internal pre-support member may be inserted into the drilled hole for the internal pre-support member in the original ground of the main tunnel from the pilot tunnel by connecting a connection pipe to the internal pre-support member so that an end part of the internal pre-support member is partially exposed to be connected to the plate type support member at a planned excavation surface of the main tunnel, and then the connection pipe may be removed, and the packer may be expanded to conduct the grouting and perform curing to thereby connect the internal pre-support member with the plate type support member.

According to another aspect of the present invention, a tunneling method using an external pre-support member and a post-support member includes: installing the external pre-support members by drilling holes from a ground surface toward a cross section and outer side parts of side walls of the cross section of a main tunnel 2 at a plurality of locations in advance before excavating the tunnel, inserting the external pre-support members and conducting grouting;

excavating the tunnel in stages in a longitudinal direction along a planned excavation line of the main tunnel 2 and primarily spraying shotcrete to an excavation surface of the main tunnel; and installing the post-support member between a plurality of the external pre-support members in the excavation surface of the main tunnel to which the shotcrete is primarily sprayed in the main tunnel; and connecting the external pre-support member and the post-support member with a plate type support member In the installing of the external pre-support members from the ground surface toward the cross section and the outer side parts of side walls of the cross section of the main tunnel in the excavation surface of the main tunnel when performing sequential excavation by a design excavation length, vertical side wall reinforcing external pre-support members installed at outer sides of left and right side wall parts of the tunnel may be installed deeper than a level of a bottom of the tunnel so as to prevent uplift of the bottom.

In the installing of the post-support member between the external pre-support members in the excavation surface of the tunnel, the post-support member may be installed in a part unsupported due to an obstruction.

The tunneling method may further include, in the installing of the post-support member between the plurality of the internal pre-support members in the excavation surface of the main tunnel to which the shotcrete is primarily sprayed in the main tunnel, continuously installing a reinforcing steel cage formed of a steel rod on the internal pre-support member and the post-support member, and putting a bearing plate on the internal pre-support member penetrating through the reinforcing steel cage and tightening an anchorage to compress and fix the reinforcing steel cage; and spraying the shotcrete to the reinforcing steel cage.

The tunneling method may further include excavating along an excavation line of the main tunnel to be constructed and installing a drainage member on the excavation surface; and primarily spraying the shotcrete to the excavation surface after installing the drainage member.

The internal pre-support member and the post-support member may be fixed to the original ground of the main tunnel by inserting the internal pre-support member after drilling a hole, and then conducting pressurized-grouting to simultaneously generate an effect of supporting the original ground and a waterproof effect.

A soil cover depth may be replaced with an artificial reinforcement material and the external pre-support member may be installed from the replaced soil cover depth to the cross section of the main tunnel and the outer side of the cross section of the main tunnel, in a case in which a soil cover depth of the main tunnel is thin and the ground of the main tunnel is soft.

The post-support member having a shorter length or a smaller diameter than that of the internal pre-support member may be used.

The reinforcing steel cage may be manufactured in a mesh form, or an interval between upper and lower steel rods may be formed in a truss form.

The internal pre-support member and the post-support member may be installed in the tunnel or the external pre-support member and the post-support member may be installed in the tunnel.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
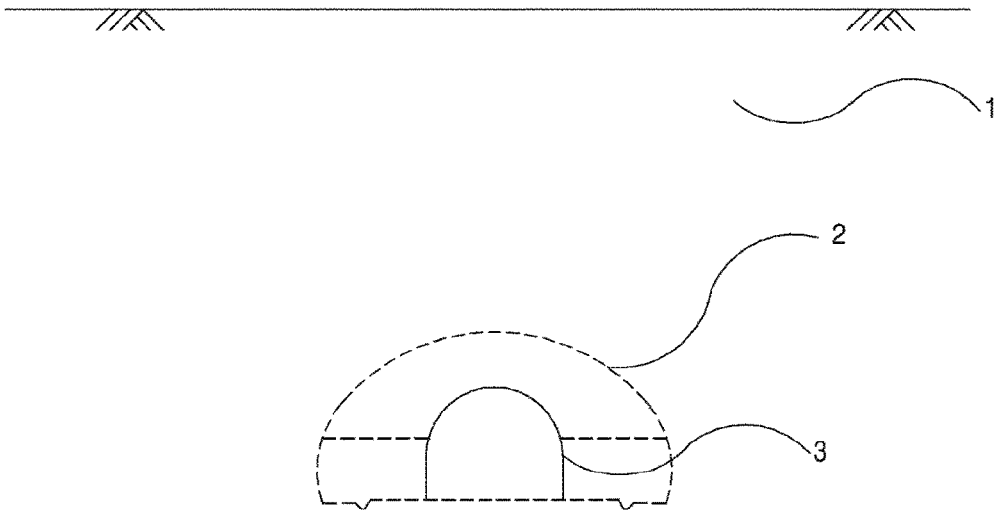
FIG. 1 is a cross-sectional view illustrating that a pilot tunnel 3 is positioned in an original ground 1 and a main tunnel 2 in a tunneling method.

Embodiments of the present invention will be described in detail with reference to the accompanying drawings. If any identical part in FIGS. 1 to 23 is not indicated by a reference numeral in a drawing, the reference numeral in other drawings will be referred to.

The present invention relates to a method of first excavating a pilot tunnel in a cross section of a main tunnel to be constructed, drilling radially at a plurality of locations in the pilot tunnel, pushing an internal pre-support member to an excavation surface of the main tunnel to be fixed and installed, excavating up to an excavation line of the main tunnel, primarily spraying shotcrete, and installing a post-support member; and a tunneling method of first drilling holes toward a tunnel from a ground surface to install an external pre-support member, excavating the tunnel, and primarily spraying shotcrete to an excavation surface, and installing a post-support member, in a case in which the drilling is possible at the ground surface.

Describing important terminologies first, an "internal pre-support" means that holes are drilled in an original ground of a main tunnel from a pilot tunnel through an excavation surface of the main tunnel by a length required for stabilization of a tunnel, by using a drill that may drill a long hole from the pilot tunnel having an excavation surface spaced apart from the excavation surface of the main tunnel toward the excavation surface of the main tunnel, and a nail is pushed into the original ground of the main tunnel an fixed by a resin, grouting, or a mechanical expansion force, and an "external pre-support" means that an external pre-support member is installed in an outer side of the excavation cross section of the tunnel vertically from a ground surface toward the tunnel and is installed to be exposed to the excavation surface of the inner side to be integrally fixed with a plate type support member installed on the excavation surface of the tunnel, and a method for integration with the original ground is the same as that of the internal pre-support.

The external pre-support member 30 is installed variously, for example, vertically or radially from the ground surface toward the excavation surface in the cross section part of the tunnel, and is vertically or slantly in side wall parts of the cross section of the tunnel, and is classified into a vertical side wall reinforcing external pre-support member 33 which is vertically installed at outer sides of the side walls of the tunnel, and an inclined side wall reinforcing external pre-support member 32 which is slantly installed in a tangential direction in the side walls of the tunnel.

An internal pre-support member and an external pre-support member are distinguished depending on a drilling location for installation, are collectively referred to as a "pre-support member", and may be a linear type support member such as a nail.

In engineering description, a nail that is installed in advance before excavating the main tunnel when there is little or no displacement or increase in stress in the original ground of the main tunnel is defined as the "pre-support member".

The pre-support member that is installed in advance exhibits a support force from the moment a tunnel face of the main tunnel is excavated. It is preferable that a material of the pre-support member has high strength and a higher elongation rate than an elongation rate until collapse of the original ground, in terms of safety. Linear type materials such as a steel rod, a steel pipe, Glass Reinforced Plastic (GRP) may be used.

The pre-support member and the post-support member are inserted by drilling a hole using a drill and fixed by the grouting. As a material for grouting, a resin capsule or cements which are an inorganic material with little chemical change over time may be used, and when a main purpose is waterproof, a solution type may be used depending on the ground condition.

A diameter (circumferential length) of the drilled hole for the pre-support member is large, that is, 105 to 200 mm in a soft ground, and is small, that is, 35 to 105 mm in bedrock in consideration of a shear strength of the injection material and the original ground.

Specially, in a mechanical expansion method, a pipe lengthily corrugated in a longitudinal direction is expanded like a swellex bolt to be fixed.

The "post-support member" is a linear type support member installed in the excavation surface after excavating the main tunnel, and has a function like the nail. One post-support member or a plurality of post-support members are installed between the pre-support members or installed in the side wall parts 18. It is preferable that a post-support member having a lower rigidity and a shorter length than those of the pre-support member, in terms of economical efficiency.

As a material of the post-support member, a steel rod, a hollowed rock bolt, a steel pipe, a perforated steel pipe, a GRP bolt, a swellex bolt, and the like may be used, and the same grouting material as that of the pre-support member such as a resin may be used.

Figure 6A:
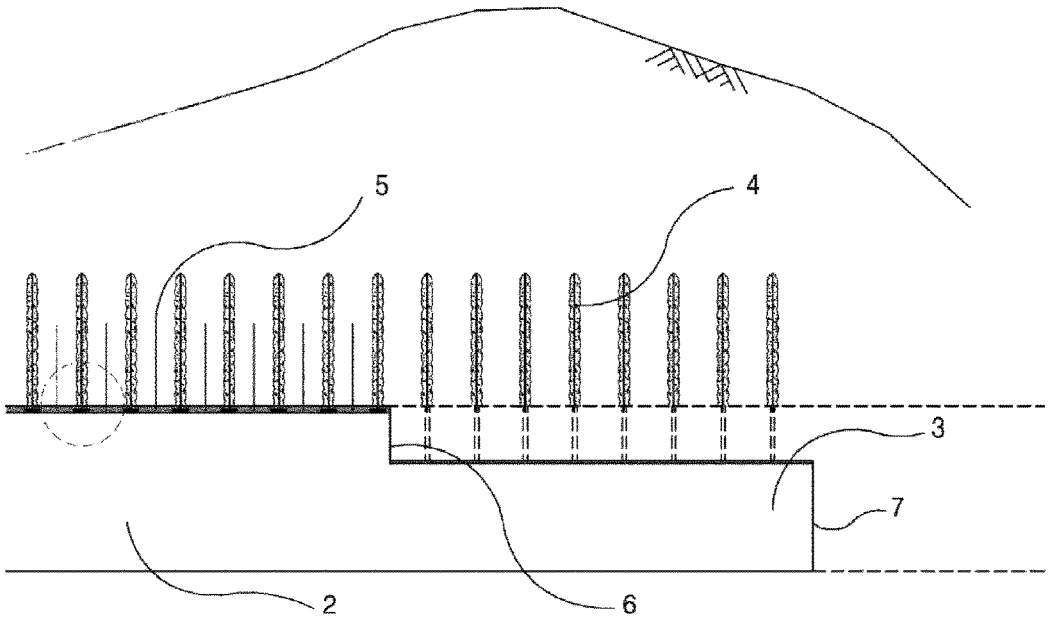
FIG. 6A is a longitudinal cross-sectional view illustrating that the main tunnel is excavated and the post-support member is installed between the pre-support members in a longitudinal direction, after installing the pre-support member from the pilot tunnel.
Figure 6B:
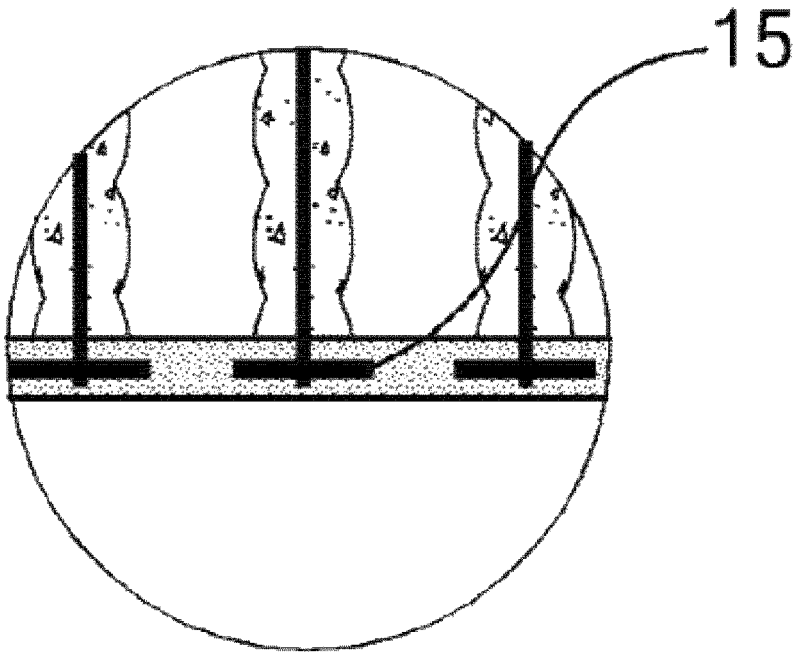
FIG. 6B is an enlarged detailed view of the combined body configured with the pre-support members and the post-support members.
Figure 16:
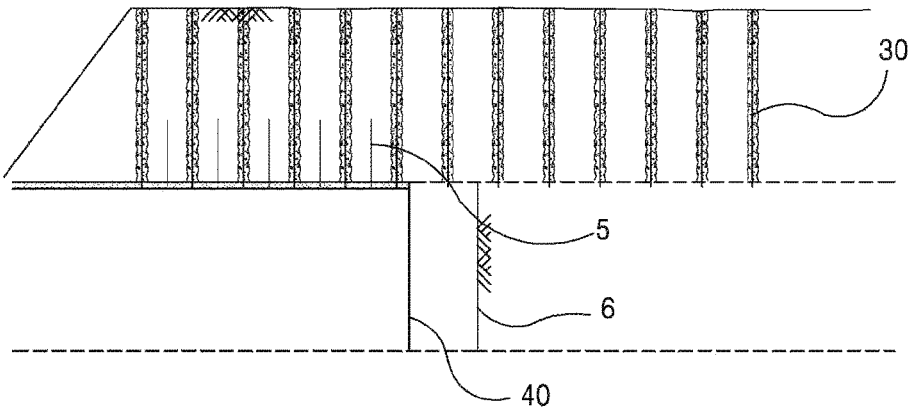
FIG. 16 is a longitudinal cross-sectional view illustrating a state in which the external pre-support member is installed, the main tunnel is excavated, and then the post-support member is installed between the pre-support members in the tunnel and a state in which the post-support member is not installed at a tunnel face 40 before the excavation and a tunnel face 6 after the excavation right after the excavation.

A method of installing the post-support member between the pre-support members spaced apart from each other in a longitudinal direction of the tunnel as in FIGS. 6 and 16 is also the same as described above.

The pre-support member and the post-support member are collectively referred to as a "linear type support member".

A reason that the pre-support member and the post-support member are installed together is as follows.

First, the stress generated in the original ground due to the tunnel excavation is largest at the excavation surface of the stress and the farther away from the excavation surface, the smaller the stress is. Accordingly, it is advantageous that the reinforcement by the support member is intensively performed at the excavation surface, and the reinforcement is less performed at a part far away from the excavation surface.

Second, if a thick and long reinforcement material is installed in the drilled hole at the time of installing the pre-support member, it is possible to secure stability of the entire tunnel by installing only the small number of pre-support members, which is computationally advantageous. However, due to characteristics of the nail, if an installation interval is large, a plastic region and small scale collapse may occur between nails, therefore, it is not possible to decrease the interval between the pre-support nails. In order to improve such problem, in the present invention, reinforcement is performed at the original ground of the main tunnel by using the minimum number of pre-support members having a high rigidity and a long length, and then shotcrete is primarily sprayed and a post-support member is additionally installed between the pre-support members during the excavation surface standing-up time, thereby additionally performing reinforcement at the wide space between the pre-support members.

Third, the cost for drilling holes is much higher than that of nail materials, and a long drilling process time is required, thus at the time of installing the pre-support member, a thick and long nail having high rigidity is installed to minimize the number of pre-support members installed, and a plurality of post-support members that may be easily installed and are cheap are installed, thereby implementing economical and easy installation.

A "main tunnel" means a tunnel as a final object, and refers to a tunnel used after completing the excavation and support process. The pre-support process performed by installing a pilot tunnel in a cross section of the tunnel is economically advantageous in a large section tunnel of a 3 or more lane road.

Since a tunnel having a smaller cross section has a limitation on mechanical construction, construction costs and a construction period are increased. In the present invention, the main tunnel refers to a tunnel as a final object.

A "pilot tunnel" refers to a tunnel having a small cross section that is formed by an existing tunneling method in the main tunnel and may easily secure structural safety. The pilot tunnel is a tunnel installed so that a planned excavation surface of the main tunnel and an excavation surface of the pilot tunnel in which the pre-support member is to be installed are spaced apart from each other, such that displacement caused by the excavation of the pilot tunnel does not affect the structure of the main tunnel or the displacement is small.

When there is a critical obstruction such as a bridge foundation outside the tunnel, thus displacement needs to be minimized, the pilot tunnel is eccentrically disposed in the main tunnel so that the excavation surface of the main tunnel to which the obstruction is adjacent and the excavation surface of the pilot tunnel are spaced apart from ach other as much as possible.

The excavation of the pilot tunnel is performed before the excavation of the main tunnel, and the pilot tunnel serves to observe the ground of the main tunnel, and serves as a working space for installing the pre-support member in the original ground of the main tunnel.

The "original ground" means the ground in which the tunnel is constructed, and more specifically, the outer ground of the main tunnel is referred to as the original ground of the main tunnel and the outer ground of the pilot tunnel is referred to as the original ground of the pilot tunnel.

A "plate type support" collectively refers to a form in which a plate type member installed in the excavation surface of the tunnel is attached to the excavation surface, and includes combining a steel fiber shotcrete or shotcrete, a wire mesh reinforcing an internal part thereof, and a reinforcing steel cage, and fixing a precast segment plate to the pre-support member as a bearing plate and grouting between the excavation surface and the precast segment plate by mortar or cement milk.

In an example according to an embodiment of the present invention, in a method of connecting the pre-support member and the post-support member with the plate type support member, shotcrete is primarily sprayed to the excavation surface, the reinforcing steel cage is fitted to the pre-support member and the post-support member that protrude on the shotcrete surface and the bearing plate is put thereon and fastened, and the shotcrete is secondarily sprayed.

FIG. 1 is a cross-sectional view illustrating that a pilot tunnel 3 is positioned in an original ground 1 and a main tunnel 2 in a tunneling method. As shown in FIG. 1, the main tunnel 2 is positioned in the original ground 1, and the pilot tunnel 3 smaller than the main tunnel 2 is positioned in the main tunnel 2. A ground surface of the original ground 1 may be a level surface or an inclined surface like a mountain depending on a location.

Figure 2:
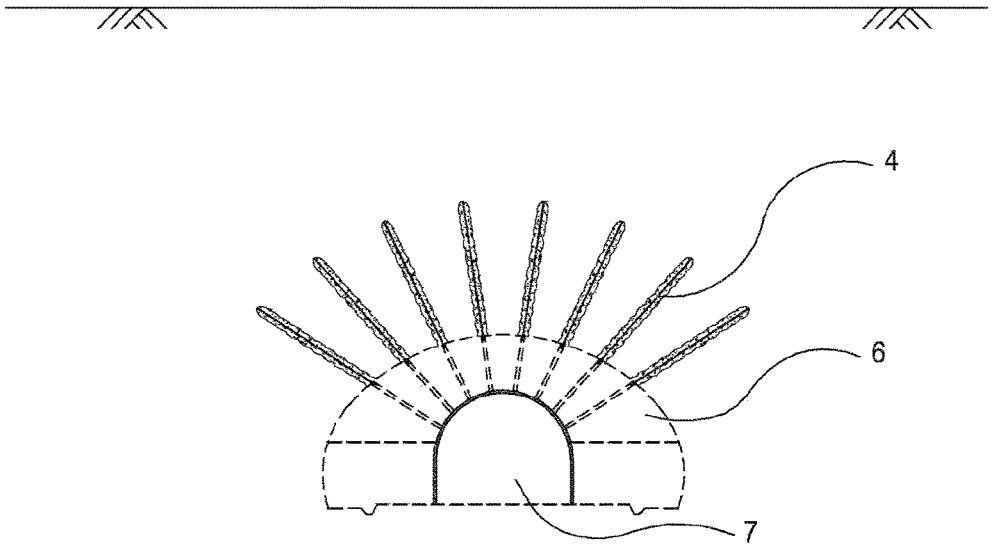
FIG. 2 is a cross-sectional view illustrating that an internal pre-support member 4 is installed in the original ground of the main tunnel from the pilot tunnel.

FIG. 2 is a cross-sectional view illustrating that an internal pre-support member 4 is installed in the original ground 1 of the main tunnel 2 from a ceiling part of the pilot tunnel 3. The internal pre-support member 4 is a structural support member of the main tunnel 2, and a length and a thickness thereof are determined depending on a width of the main tunnel 2. The required number or more of internal pre-support members for standing-up of an excavation surface of the main tunnel 2 for an operation time when performing sequential excavation to the excavation surface of the main tunnel 2 by a design excavation length are installed by drilling, and generally, a pressurized-grouting is conducted using cement milk and curing is performed. Here, the operation time for which the standing-up happens means a time for which the excavation and support process is completed in the tunnel.

In order to facilitate injection, and simultaneously exhibit high strength and the waterproof effect, as the injection material, suspension type high fineness micro cement, a solution type injection material or a mixture thereof are injected.

As the solution type material, various solution type injection materials such as silica sol, urethane, or the like may be used.

As the injection method, multi-stage injection may be performed by installing a plurality of hoses having different lengths into drilled holes, or two or more packers may be installed and different kinds of liquid chemicals may be injected in multiple stages depending on required effects.

The pilot tunnel 3 may be constructed by an existing tunnel excavation and support method, and shotcrete and a rock bolt which are general support members are installed on an excavation surface thereof.

In a case of the internal pre-support member 4, a hole is drilled in the original ground 1 of the main tunnel 2 from the pilot tunnel 3 through the excavation surface of the main tunnel 2 by a length required for stabilization of the tunnel, by using a drill capable of drilling a long hole at the pilot tunnel 3, the pre-support member 4 is inserted by connecting a connection pipe, and then the grouting is conducted after removing the connection pipe.

Figure 3:
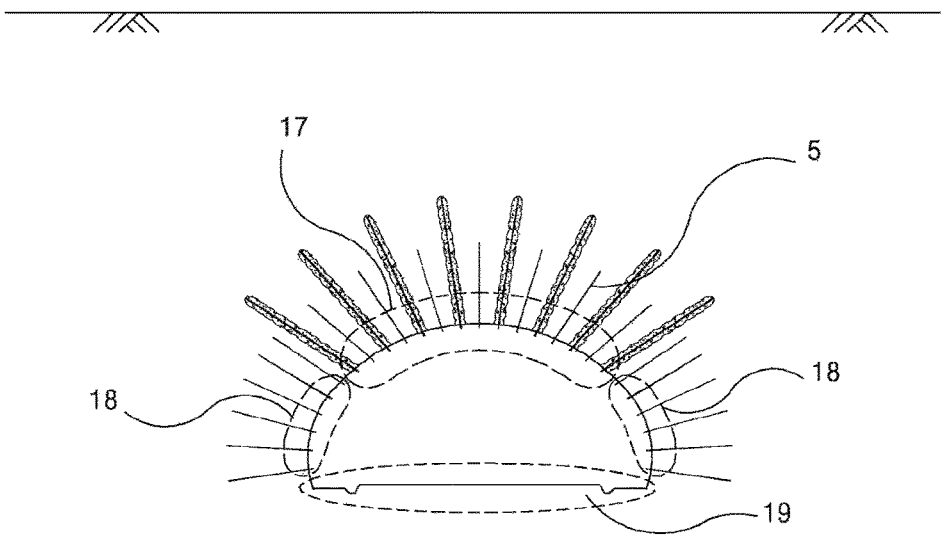
FIG. 3 is a cross-sectional view illustrating a ceiling part 17 in which a post-support member 5 is installed between the pre-support members and side wall parts 18 in an excavation surface of the main tunnel, after performing excavation between an excavation surface of the pilot tunnel and the excavation surface of the main tunnel according to the present invention.

FIG. 3 is a cross-sectional view illustrating that after excavating between the excavation surface of the pilot tunnel 3 and the excavation surface of the main tunnel 2, a post-support member 5 is installed between the pre-support members 4 at the a ceiling part 17 of the excavation surface of the main tunnel 2. In a state in which the internal pre-support member 4 is installed after excavating the pilot tunnel 3, a tunnel face 6 of the main tunnel 2 is excavated and then pumice stone is removed, and shotcrete is primarily sprayed on the excavation surface of the main tunnel 2.

Then, one or more holes are drilled between the internal pre-support member 4 to install the post-support member 5, the post-support member 5 is inserted into the drilled hole, and the grouting is conducted. A post-support member 5 having a shorter length and a thinner thickness than those of the internal pre-support member 4, or a post-support member 5 having a shorter length or a thinner thickness than that of the internal pre-support member 4 may be used. The post-support member 5 may be fixed by using a resin or by conducted the grouting like the internal pre-support member 4.

Next, reinforcement materials such as a reinforcing steel cage, a steel support member, or a lattice support member are installed by being fitted to the internal pre-support member 4 and the post-support member 5, inserting the bearing plate, and tightening nuts, and the shotcrete is secondarily sprayed, such that the plate type support member capable of making the excavation surface of the tunnel endure pressure and the linear type support member are fixedly coupled to each other. In consideration of anisotropic tensile force and compression of the ground, side wall parts 18 are structurally safe as compared to the ceiling part 17, it is possible to secure safety even when only the post-support member is used for support in the tunnel, except for a case of the soft ground. In a case of a bottom part 19, if a lower ground of the tunnel is the soft ground, the post-support member may also be used for reinforcement of the bottom part.

Figure 4:
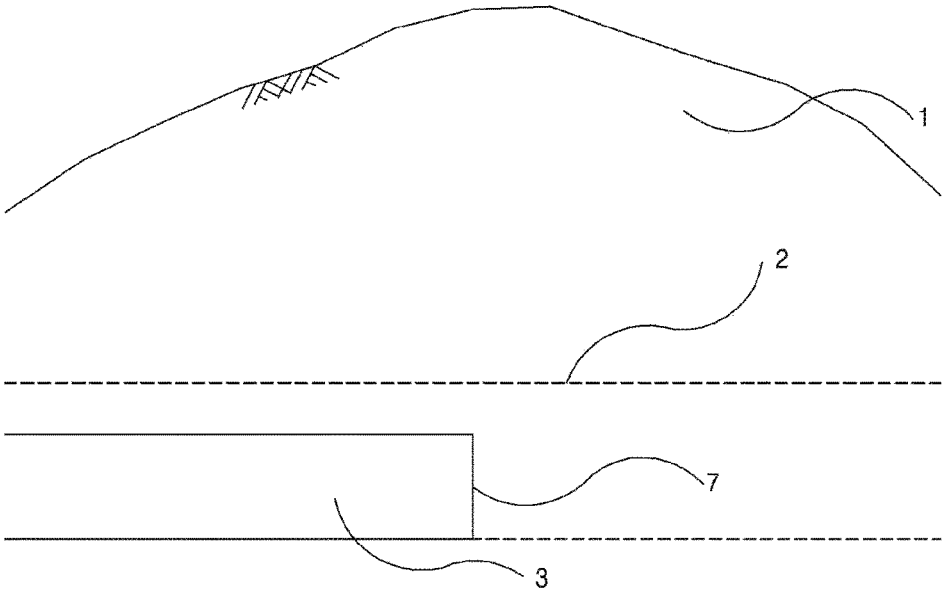
FIG. 4 is a longitudinal cross-sectional view illustrating that the pilot tunnel is excavated in the original ground.

FIG. 4 is a longitudinal cross-sectional view illustrating that the pilot tunnel 3 is excavated in the main tunnel 2. Ground information of the tunnel may be completely acquired from a pilot tunnel face 7 through mapping when excavating the pilot tunnel 3, such that a design may be reviewed before excavating the main tunnel thereby enabling perfect construction.

However, in the existing construction method, only the ground of an entrance and an exit of the tunnel is investigated, and in a case of a central part of the tunnel where a soil cover depth is positioned at high altitude, inferential design is made through physical prospecting with relatively low precision, thus if an unexpected weak zone appears during excavation, the construction of the main tunnel needs to be stopped and the designed should be reviewed, which is cumbersome.

Figure 5:
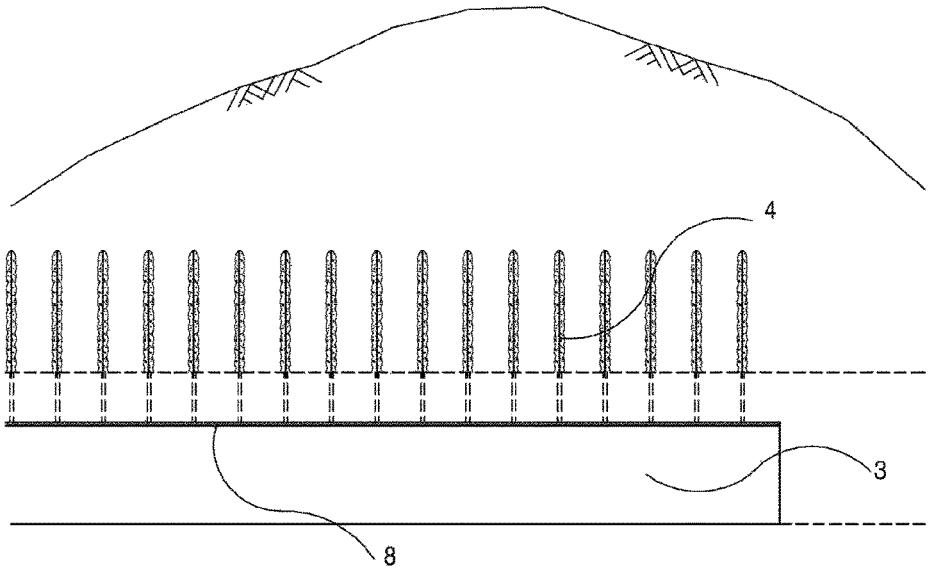
FIG. 5 is a longitudinal cross-sectional view illustrating a state in which the pre-support member is installed in the original ground of the main tunnel from the pilot tunnel so that the pre-support member is exposed to the excavation surface of the main tunnel.

FIG. 5 is a longitudinal cross-sectional view illustrating that in the radially forming of the drilled holes at a plurality of locations in the pilot tunnel 3 to install the required number or more of internal pre-support members 4 for standing-up of the excavation surface for an operation time when performing sequential excavation to the excavation surface of the main tunnel 2 by a design excavation length, grouting is conducted and curing is performed in order to insert and install the internal pre-support member 4 in the radial drilled hole to be fixed.

Describing in detail, FIG. 5 is a longitudinal cross-sectional view illustrating that the pre-support member 4 is installed in the original ground 1 of the main tunnel 2 from the pilot tunnel 3 to which shotcrete 8 is sprayed so that the pre-support member 4 is exposed to the excavation surface of the main tunnel 2. The pilot tunnel 3 is excavated in the main tunnel 2, a plurality of holes are radially drilled in the pilot tunnel 3, and the internal pre-support member 4 is pushed into the hole by connecting a connection pipe. At this time, the internal pre-support member 4 is installed while having a tip end thereof exposed to the inside of the tunnel so that the internal pre-support member 4 is connected to the shotcrete reinforcing the excavation surface after excavating the main tunnel 2.

For safety during the construction, at least two or more stoppers are attached to the internal pre-support member 4 at an interval of 2 to 5 m so that the internal pre-support member 4 is positioned at the center of the drilled hole without falling after being inserted. Further, in order to conduct the pressurized-grouting, an injection hose 13 and a discharge hose are attached up to the tip end of the internal pre-support member 4 using a binding wire. In a case in which the original ground 1 is fresh, the discharge hose is additionally attached to be long so that a level of the discharge hose is higher than that of the injection hose 13, a sack-packer 11 is attached to the tip end of the internal pre-support member 4 of the inside of the tunnel to enable the pressurized-grouting. The sack-packer 11 is installed to be positioned at an excavation part of the excavation surface of the main tunnel 2.

FIG. 6 is a longitudinal cross-sectional view illustrating that the tunnel is excavated in stages in a longitudinal direction along an excavation line of the main tunnel, the shotcrete is primarily sprayed, the post-support member 5 is installed between the pre-support members 4 in the excavation surface to which the shotcrete is primarily sprayed, and the pre-support member and the post-support member are connected with the plate type support member. FIG. 6 is a view illustrating that after expandingly excavating the pilot tunnel 3 up to the excavation surface of the main tunnel 2, the post-support member 5 is installed between the internal pre-support members 4 installed at the pilot tunnel 3, in the excavation surface of the main tunnel to which the shotcrete is sprayed, and as the post-support member 5, a nail having a shorter length and a thinner thickness than those of the internal pre-support member 4 is installed, the bearing plate 15 is compressed to the tip ends of the post-support member and the internal pre-support member, and the shotcrete is secondarily sprayed to complete the support process. By doing so, structurally, the internal pre-support member 4 and the post-support member may serve to support the original ground, and the internal pre-support member 4 and the post-support member may be fixed with the plate type support member 8 supporting the excavation surface.

Figure 7:
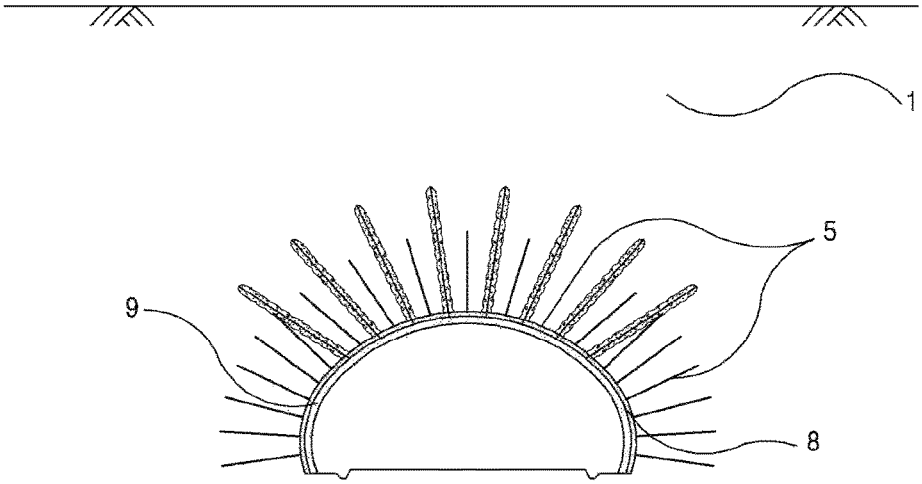
FIG. 7 is a view illustrating a state in which installation of the pre-support member and the post-support member and installation of a lining are completed.

FIG. 7 is a view illustrating a state in which installation of a lining 9 is completed after the pre-support member 4 and the post-support member 5 are installed and connected and fixed with the plate type support member 8.

Figure 8:
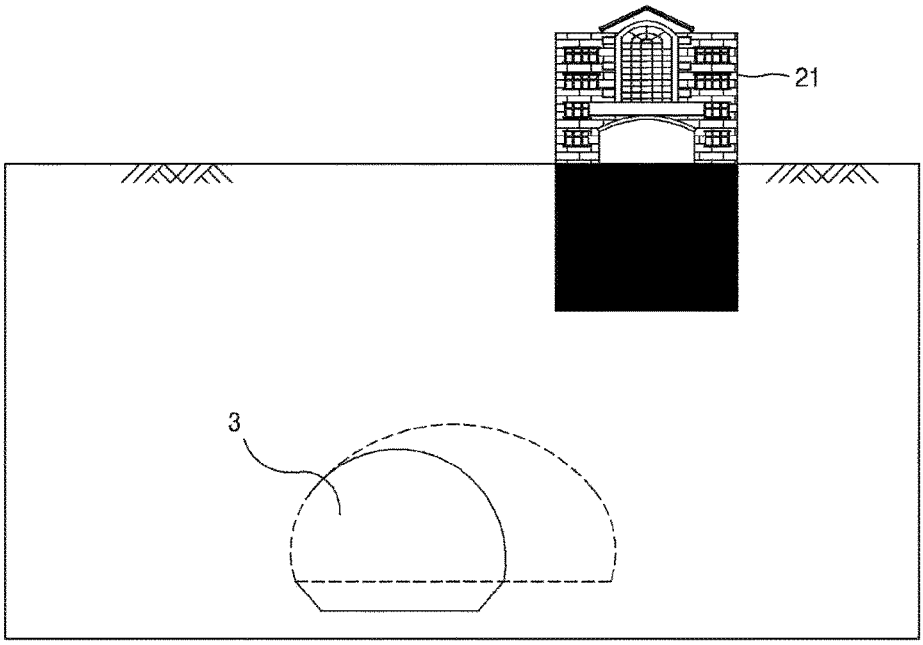
FIG. 8 is a view illustrating a state in which when there is a critical obstruction such as a building or a bridge foundation outside the tunnel, thus displacement needs to be minimized, the pilot tunnel is eccentrically disposed in the main tunnel so that a planned excavation surface of the main tunnel to which the obstruction is adjacent and the excavation surface of the pilot tunnel are spaced apart from each other as much as possible.

FIG. 8 illustrates a state in which when there is a critical obstruction 21 such as a building or a bridge foundation outside the tunnel, thus displacement of the pilot tunnel 3 needs to be minimized, the pilot tunnel 3 is eccentrically disposed in the main tunnel 2 so that a planned excavation surface of the main tunnel 2 to which the obstruction 21 is adjacent and the excavation surface of the pilot tunnel 3 are spaced apart from each other as much as possible. An additionally excavated part in the bottom part 19 is to secure a drilling angle of a drilling machine at the time of the drilling operation.

Figure 9:
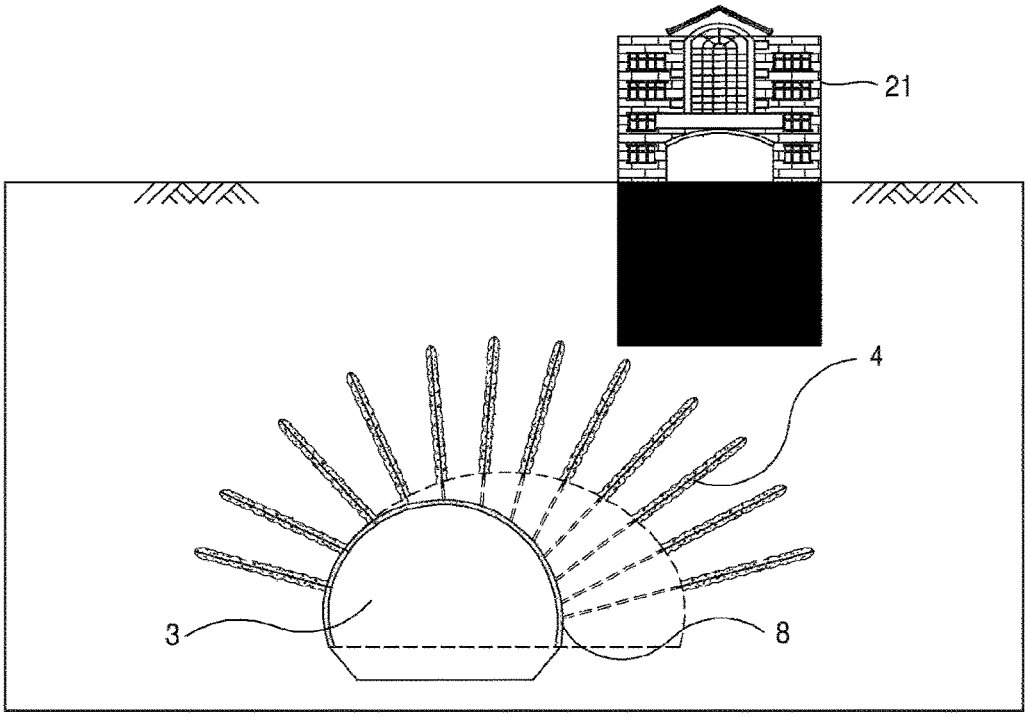
FIG. 9 is a cross-sectional view illustrating a state in which the pre-support member is installed in the original ground of the main tunnel from the pilot tunnel that is eccentrically disposed while being spaced apart from a position of the obstruction.

FIG. 9 is a cross-sectional view illustrating a state in which the pre-support member 4 is installed in the original ground 1 of the main tunnel 2 from the pilot tunnel 3 that is eccentrically disposed while being spaced apart from a position of the obstruction 21.

Figure 10:
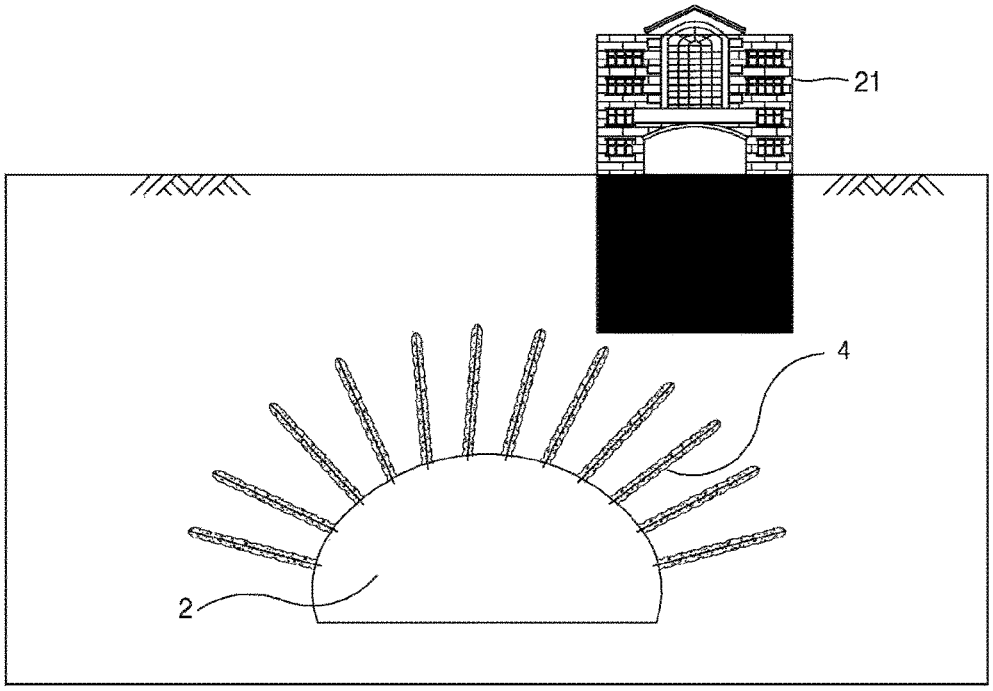
FIG. 10 is a cross-sectional view illustrating a state of excavating the main tunnel.

FIG. 10 which is a cross-sectional view illustrating a state of excavating the main tunnel 2 illustrates a state in which the additionally excavated part in the bottom part is refilled.

Figure 11:
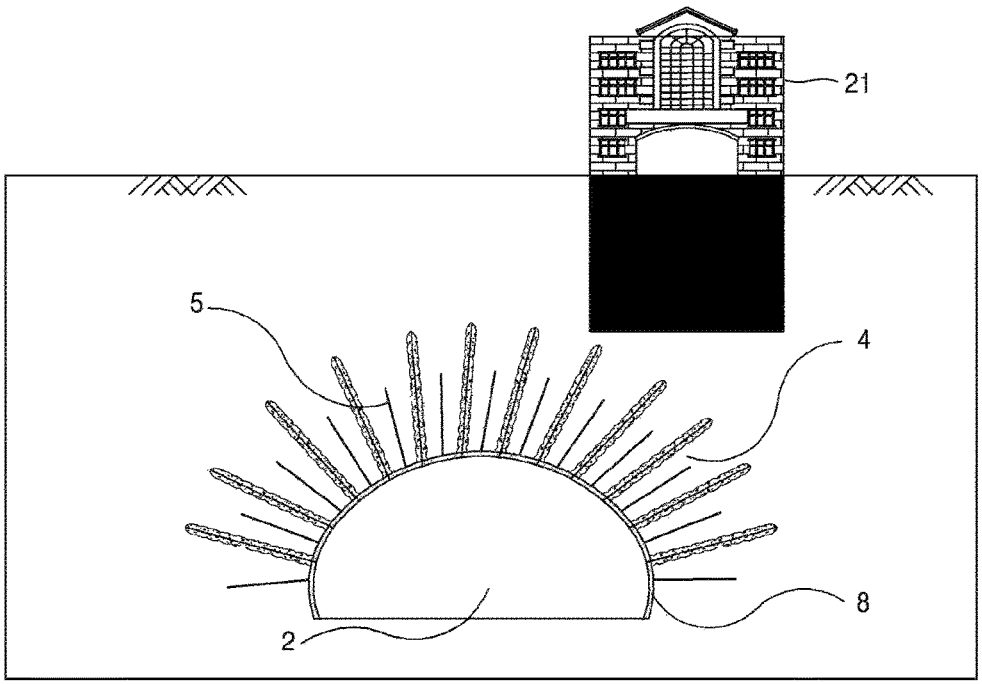
FIG. 11 is a cross-sectional view illustrating a state in which shotcrete is primarily sprayed in a state of excavating to the excavation surface of the main tunnel, the post-support member is installed between the pre-support members, installing a bearing plate or a reinforcing steel cage and the bearing plate, and spraying the shotcrete as a finish.

FIG. 11 is a cross-sectional view illustrating a state in which shotcrete is primarily sprayed after the installation of the internal pre-support member in FIG. 10, the post-support member 5 is installed between the pre-support members, and the shotcrete is secondarily sprayed to connect between the plate type support member, and the pre-support member and the post-support member.

Figure 12:
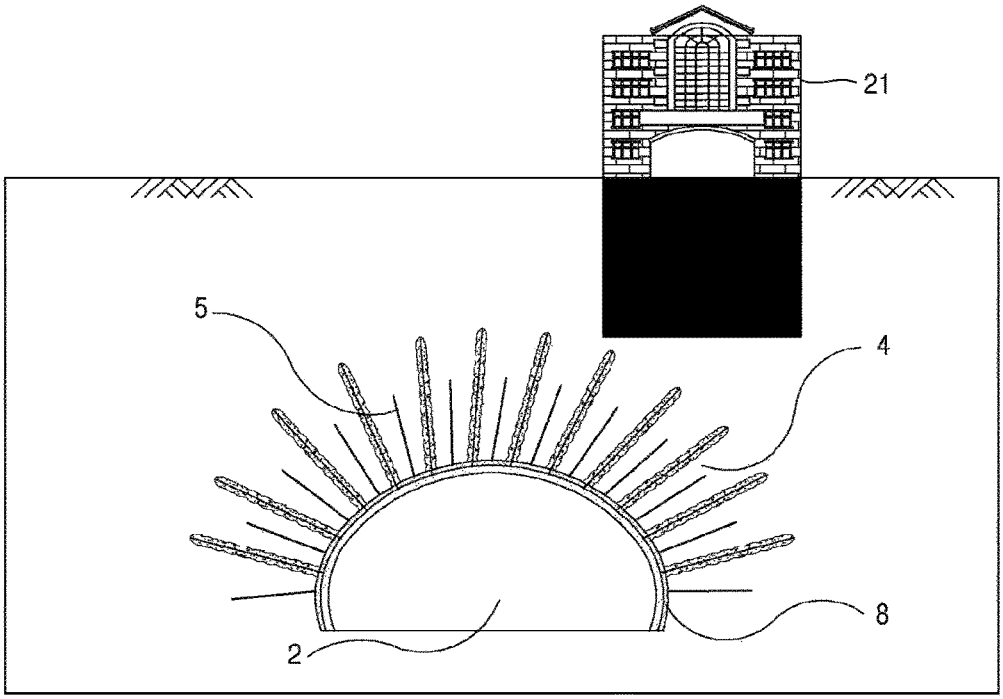
FIG. 12 is a cross-sectional view illustrating a state in which the installation of the lining is completed in FIG. 11.

FIG. 12 is a final drawing illustrating the construction processes of FIGS. 8 to 11, and is a cross-sectional view illustrating a state in which after the internal pre-support member 4 is installed in the original ground 1 of the main tunnel 2 from the pilot tunnel 3 that is eccentrically disposed while being spaced apart from the position of the obstruction 21, the shotcrete is primarily sprayed, the post-support member 5 is installed between the pre-support members, the shotcrete is secondarily sprayed to connect between the plate type support member, and the pre-support member and the post-support member, and the installation of the lining 9 is completed.

Figure 13A:
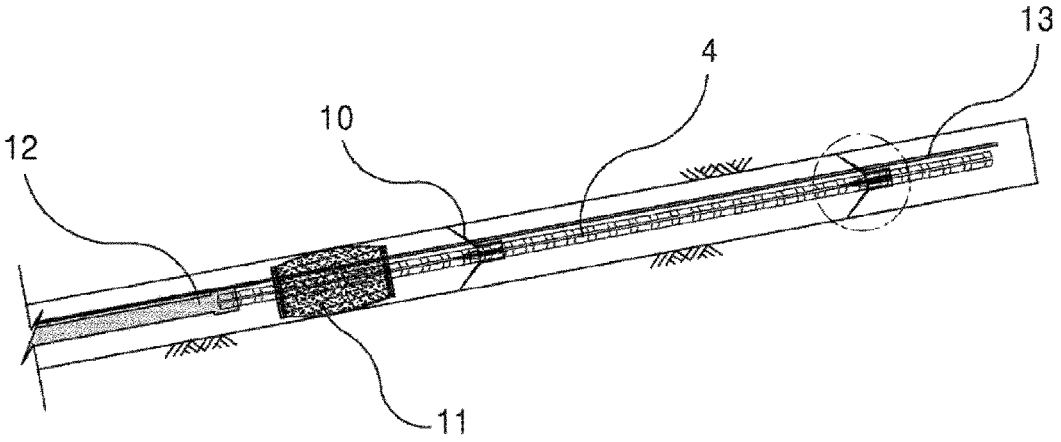
FIG. 13A is a cross-sectional view illustrating a state in which the pre-support member is inserted into a drilled hole of the main tunnel.
Figure 13B:
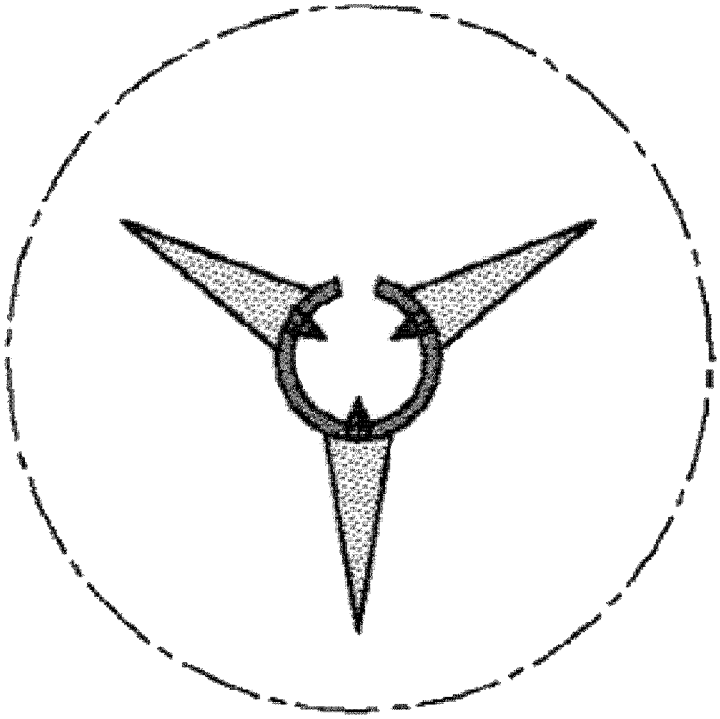
FIG. 13B is an enlarged detailed view of the inserted pre-support member surrounded by stoppers.

FIG. 13 is a view illustrating that a connection pipe 12 for pushing the internal pre-support member 4 into the long hole drilled at the pilot tunnel 3 is connected to the internal pre-support member 4, and for safety during the construction, stoppers 10 are installed on the pre-support member 4 at an interval of 2 to 5 m so that the pre-support member 4 is positioned at the center of the drilled hole without falling after being inserted, and the sack-packers 11 are installed at tip ends of the discharge hose and the injection hose 13. The number of stoppers 10 installed on the pre-support member 4 needs to be at least 2 or more.

Figure 14:
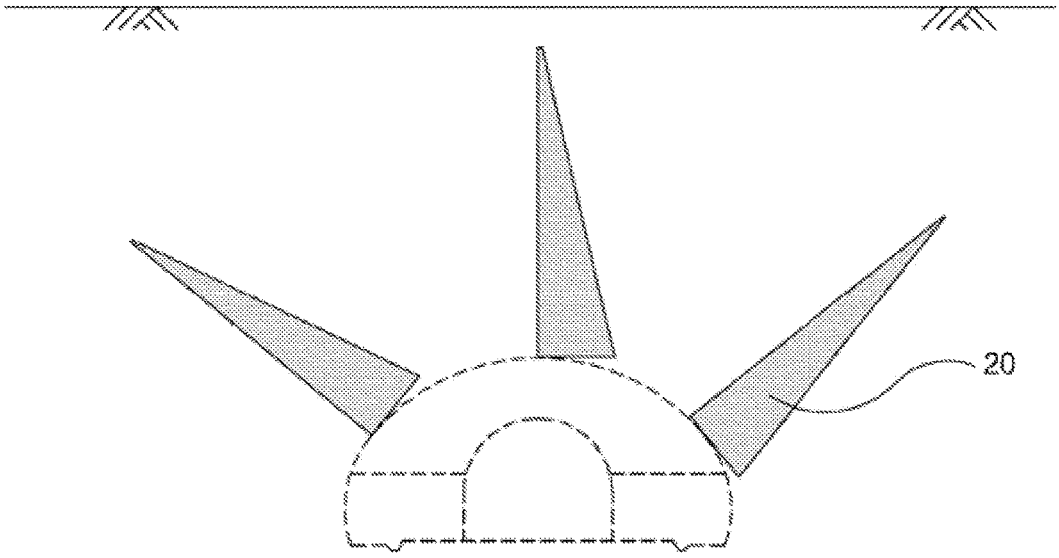
FIG. 14 is a stress diagram of the original ground showing that when excavating the main tunnel, stress applied to the original ground is largest at the excavation surface, and is gradually decreased toward the outer side from the excavation surface.

FIG. 14 is a diagram illustrating that when excavating the main tunnel 2, stress applied to the original ground and stress applied to the linear type support member are largest at the excavation surface, and are gradually decreased toward the outer side from the excavation surface. Installing both of the long pre-support members 4 and 30 and the short post-support member 5 therebetween as in FIGS. 3 and 15 is the most economical support method.

Since the original ground 1 is formed of an anisotropic material of which a strength in a compression direction is large and a strength in a tensile strength is small, it is safe to install only the post-support member 8 in the side wall parts 18 that are mostly compressed.

However, in the soft ground such as the silt ground, the internal pre-support member 4 and the post-support member 5 are installed also in the side walls similarly to the ceiling part 17.

Figure 15:
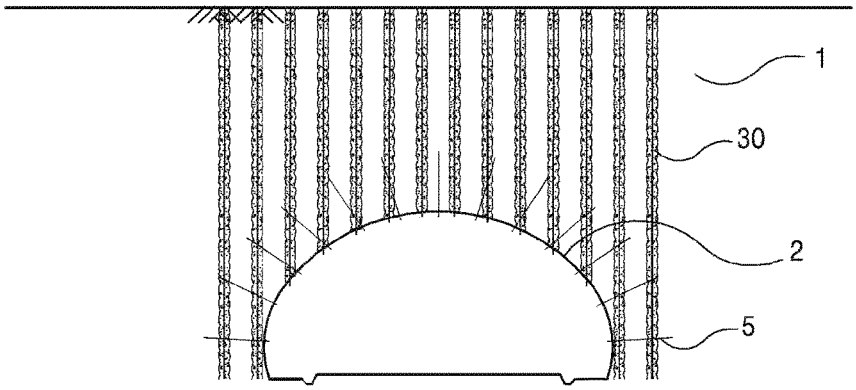
FIG. 15 is a cross-sectional view illustrating that an external pre-support member is installed, the main tunnel is excavated, and then a post-support member is installed in the excavation surface in the tunnel.

FIG. 15 illustrates a state in which the required number or more of external pre-support members 30 for standing-up of the excavation surface of the main tunnel 2 for an operation time when performing sequential excavation by a design excavation length of the main tunnel 2 are installed at a plurality of locations from the ground surface 31 toward a cross section and outer side parts of the side walls of the cross section of the main tunnel 2 in advance before the tunnel excavation, a planned cross section of the tunnel is excavated, shotcrete is sprayed to the excavation surface in the tunnel, the post support member is installed between the external pre-support members exposed to the excavation surface in the tunnel, and then on the excavation surface in the above state, the post-support member 5 and the external pre-support members 30 are connected with the plate type support member. Here, the operation time for which the standing-up of the excavation surface happens means a time for which the excavation and support process is completed.

The post-support member is a linear type support member installed in the excavation surface after excavating the main tunnel, and has a function like the nail. One post-support member or a plurality of post-support members are installed between the pre-support members or installed in the side wall parts 18. It is preferable that a post-support member having a lower rigidity and a shorter length than those of the pre-support member, in terms of economical efficiency.

In FIG. 16, a method of installing the post-support member between the pre-support members spaced apart from each other in a longitudinal direction of the tunnel is also the same as described above like in FIG. 6.

Figure 17:
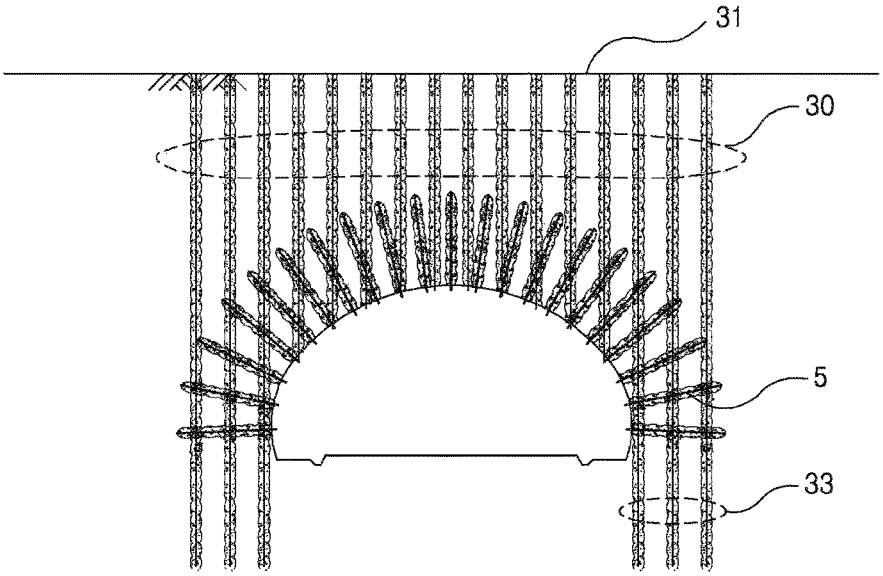
FIG. 17 is a view illustrating that a vertical side wall reinforcing external pre-support member 33 is installed deeper than a bottom of the tunnel to induce a load of a soil cover depth of the tunnel to side wall parts and prevent uplift displacement of the bottom of the tunnel, in which a reference numeral 30 indicates an external pre-support member 30 indicated by an oval dotted-line area, and a reference numeral 33 indicates the vertical side wall reinforcing external pre-support member 33 which is one of the external pre-support member.

FIG. 17 is a view illustrating that in the installing of the required number or more of external pre-support members 30 for standing-up of the excavation surface when performing sequential excavation by a design excavation length of the tunnel at a plurality of locations from the ground surface 31 toward a cross section and outer side parts of the side walls of the cross section of the main tunnel 2 in advance before the tunnel excavation, the vertical side wall reinforcing external pre-support members 33 installed at outer sides of left and right side wall parts are installed deeper than a level of the bottom of the tunnel so as to prevent uplift of the bottom. In a case in which the ground of the bottom of the tunnel is soft, the ground may be uplifted by a load of the left and right side walls of the tunnel. In order to prevent such a problem, the vertical side wall reinforcing external pre-support members 33 may be installed deeper than the bottom in the side wall parts to support the vertical load of the left and right side walls, thereby preventing the uplift of the bottom, and implementing a shear strengthening effect for a displacement vector in a bottom direction expressed in numerical analysis. Further, installation of the internal post-support member between the vertical side wall reinforcing external pre-support members 33 in a longitudinal direction serves to reinforce the vertical side wall reinforcing pre-support member 33 to prevent the vertical side wall reinforcing pre-support member 33 from buckling.

Figure 18:
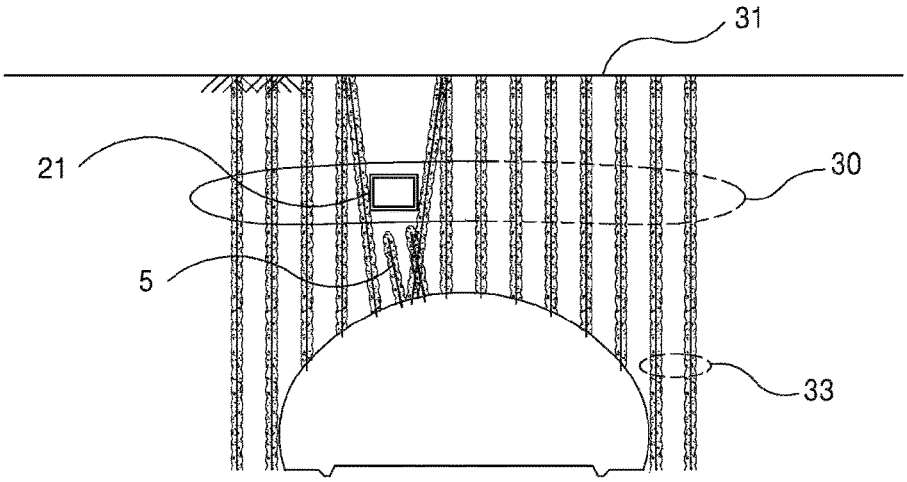
FIG. 18 is a cross-sectional view illustrating that in a case in which since there is an obstruction above the tunnel, the external pre-support may not be performed as much as a width of the obstruction, the post-support member 5 is additionally installed in a non-reinforced part in the tunnel for reinforcement.

FIG. 18 illustrates that in the installing of the required number or more of external pre-support members 30 for standing-up of the excavation surface for an operation time when performing sequential excavation by a design excavation length of the tunnel at a plurality of locations from the ground surface 31 toward a cross section and outer side parts of the side walls of the cross section of the main tunnel 2 in advance before the tunnel excavation, if there is an obstruction, the external pre-support member is slantly installed to minimize an unsupported part.

However, in a case in which the external pre-support members are not sufficiently installed in the upper ground of the cross section of the main tunnel due to the obstruction, in the installing of the post-support member between the external pre-support members 30 exposed to the excavation surface in the tunnel, one or more post-support members are installed in the section in the unsupported state due to the obstruction.

Figure 19:
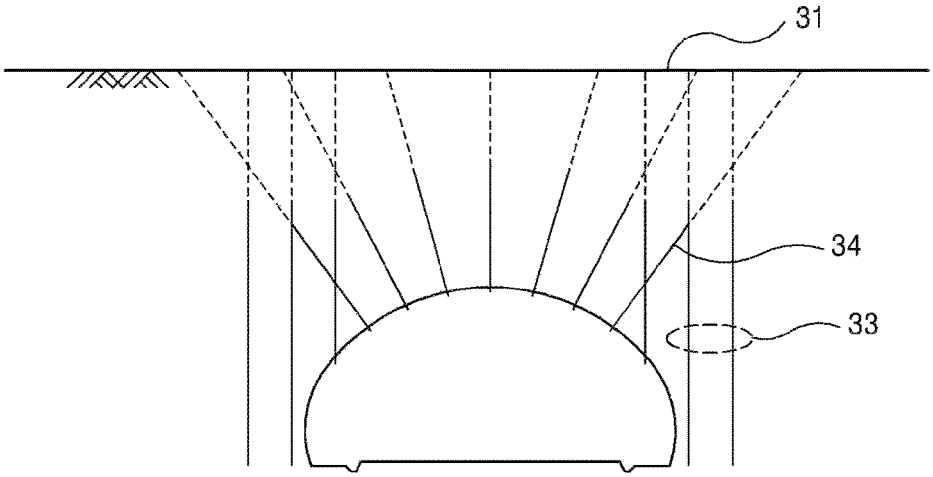
FIG. 19 is a cross-sectional view illustrating that radial direction external pre-support members 34 are installed radially toward a planned cross section of the main tunnel from a ground surface 31, and the vertical side wall reinforcing external pre-support member 33 is installed.

FIG. 19 is a cross-sectional view illustrating that radial direction external pre-support members 34 are installed radially toward a planned cross section of the main tunnel from a ground surface 31, and the vertical side wall reinforcing external pre-support member 33 is installed.

Figure 20:
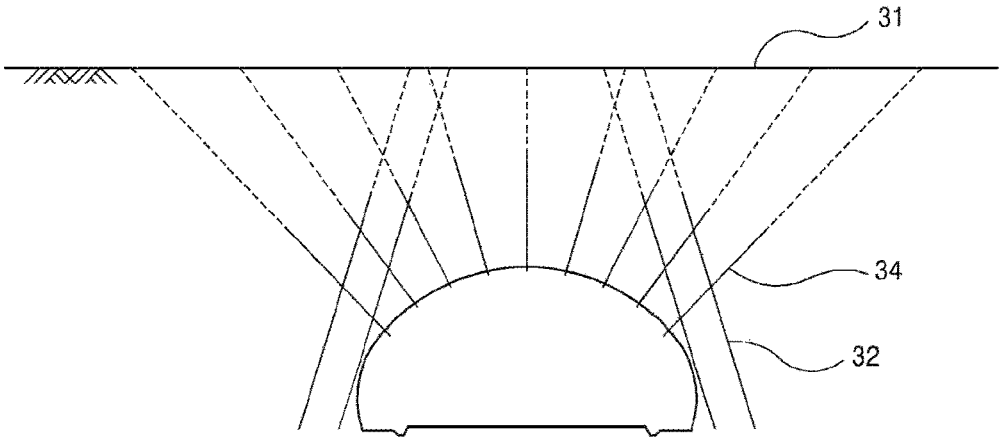
FIG. 20 is a cross-sectional view illustrating that the radial direction external pre-support members 34 are installed radially toward a planned cross section of the main tunnel from the ground surface 31, and an inclined side wall reinforcing external pre-support member 32 is installed.

FIG. 20 is a view illustrating that the radial direction external pre-support members 34 are installed radially toward a planned cross section of the main tunnel from the ground surface 31, and an inclined side wall reinforcing external pre-support member 32 is installed. Embodiments in which the external pre-support member is variously installed are illustrated in FIGS. 15 to 20. That is, the external pre-support member 30 includes, the radial direction external pre-support member 34, the inclined side wall reinforcing external pre-support member 32, and the vertical side wall reinforcing external pre-support member 33.

Figure 21:
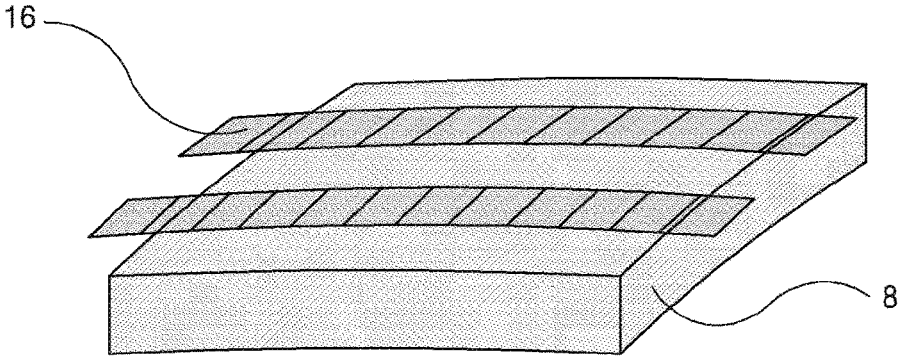
FIG. 21 is a perspective view illustrating a state in which a band-type drainage member is installed on the back of the shotcrete.

FIG. 21 is a perspective view illustrating that a band-type drainage member 16 is installed between the excavation surface and the shotcrete 8. FIG. 21 illustrates that the tunnel is excavated along the excavation line of the main tunnel, the drainage member 16 is installed on the excavation surface, and the shotcrete 8 is sprayed to the excavation surface on which the drainage member 16 is installed. The drainage member installed on the excavation surface has a band-type or a perforated pipe type, and needs to be continuously connected along the excavation surface for drainage to dummy ditches buried at both side walls of the bottom of the tunnel. If the drainage member is installed as described above before spraying the shotcrete, it is possible to prevent efflorescence generated in the water passing through the shotcrete, thus the drain system may not be clogged. This may also be applied to a 2-arch tunnel or a general tunnel.

Figure 22:
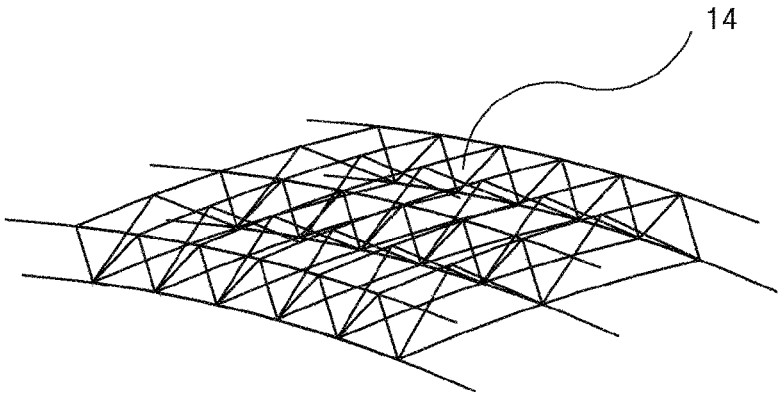
FIG. 22 is a view illustrating a reinforcing steel cage that is a steel cage in a truss form for reinforcing shotcrete and is manufactured in an appropriate size depending on an interval between the pre-support members and a ground condition to be installed.

FIG. 22 is a view illustrating a reinforcing steel cage 14 that is made of a steel rod for reinforcing shotcrete and is manufactured by automatic welding. The reinforcing steel cage is formed to have a shape in which upper and lower steel rods are welded in a truss form to match the radius of curvature of the cross section of the tunnel, the welded steel rods are stood in parallel at an interval of 15 to 50 cm, a distribution bar is welded vertically at an interval of 20 to 100 cm, and upper and lower distribution bars are welded in a truss form by putting steel rods, or have a mesh form.

A length in a cross section direction may be a length corresponding to ⅓ to ½ of the circumferential length of the tunnel when partial excavation is needed. At this time, an end part of the reinforcing steel cage needs to be additionally extended by a length for lap splice.

As another method, screw type steel rods may be used and coupled by a coupler one by one. An installation method of the reinforcing steel cage is as follows. After excavating the main tunnel 2, pumice stone is removed and then shotcrete is primarily sprayed, the reinforcing steel cage 14 is fitted to the pre-support member 4 and fixed by the bearing plate, and the shotcrete is sprayed as a finish.

Figure 23:
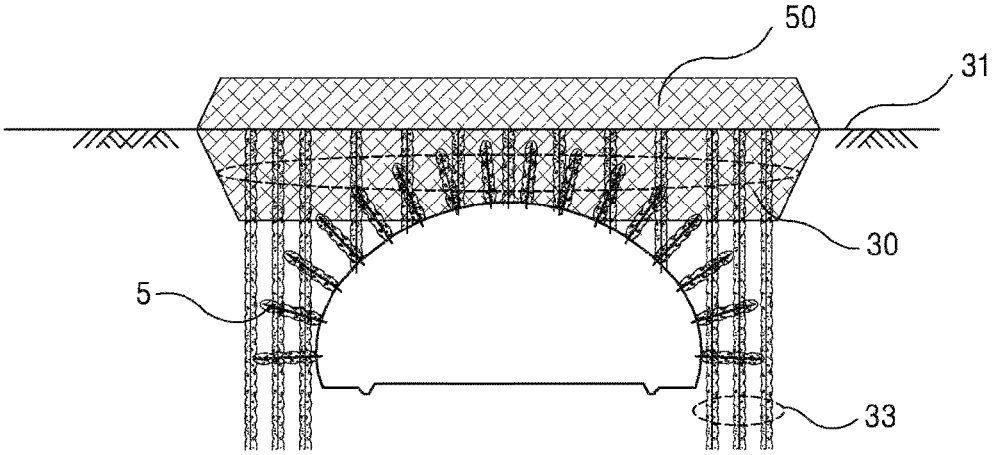
FIG. 23 is a view illustrating that in a case in which the soil cover depth of the main tunnel is shallow and the ground is soft in FIG. 15, the soil cover depth is replaced with an artificial reinforcement material and the external pre-support member is installed from the replaced soil cover depth to the cross section of the tunnel and the outer side of the cross section of the tunnel, in which the reference numeral 30 indicates the entire oval dotted-line area, that is, the external pre-support member 30, and the reference numeral 33 indicates the vertical side wall reinforcing external pre-support member 33 that is vertically installed in the side walls of the tunnel among the external pre-support members.

As illustrated in FIG. 23, in the case in which the soil cover depth of the main tunnel is thin and the ground of the main tunnel is soft in FIG. 15, the soil cover depth is replaced with an artificial reinforcement material and the external pre-support member is installed from the replaced soil cover depth to the cross section of the tunnel and the outer side of the cross section of the tunnel.

A first embodiment of the present invention will be described in detail.

A tunneling method includes excavating a pilot tunnel 3 in a main tunnel 2 to be constructed; radially forming a drilled hole from an excavation surface of the pilot tunnel 3 to a tip end of the pre-support member of the main tunnel at a plurality of locations in the pilot tunnel 3 to install an internal pre-support member 4; inserting the internal pre-support member 4 into the drilled hole, and conducting grouting and performing curing to fix the internal pre-support member 4; excavating the tunnel in stages in a longitudinal direction along an excavation line of the main tunnel 2 and primarily spraying shotcrete to an excavation surface of the main tunnel in the main tunnel; installing a post-support member 5 between a plurality of internal pre-support members 4 in the excavation surface of the main tunnel to which the shotcrete is primarily sprayed; and connecting the internal pre-support member 4 and the post-support member 5 with a plate type support member.

A connection method of the plate type support member includes the following processes: primarily spraying shotcrete to an excavation surface, installing a post-support member 5 between internal pre-support members 4 in the excavation surface, and putting and tightening a bearing plate to the internal pre-support members 4 and the post-support member 5 on the primarily sprayed shotcrete using an anchorage; secondarily spraying the shotcrete to the installed bearing plate; and installing a waterproof sheet and installing a lining, thereby completing a tunnel.

In the case in which the ground is bedrock, a method of installing the post-support member 5 between the internal pre-support member 4 in the ceiling part 17 of the tunnel, and installing only the post-support member 5 in the side wall parts 18 is a more optimized design method.

In the method of installing the internal pre-support member 4 and the post-support member 5, the post-support member 5 may also be installed between the internal pre-support members 4 spaced apart from each other in the longitudinal direction which is a tunnel excavation direction.

In a method of inserting and installing the internal pre-support member 4, a connection pipe for pushing the internal pre-support member 4 into the long hole drilled at the pilot tunnel 3 is connected to the internal pre-support member 4, and for safety during the construction, stoppers 10 are installed on the pre-support member 4 at an interval of 2 to 5 m so that the pre-support member 4 is positioned at the center of the drilled hole without falling after being inserted, a discharge hose and an injection hose 13 are attached on a side surface by a binding wire, sack-packers 11 are installed at tip ends of the discharge hose and the injection hose 13 of the tunnel excavation surface side, and the number of stoppers 10 installed on the pre-support member 4 needs to be at least 2 or more.

In the installation method, long holes for inserting a plurality of internal pre-support members are radially drilled in the original ground 1 of the main tunnel from the pilot tunnel 3, the internal pre-support member 4 is inserted into the original ground 1 from the pilot tunnel 3 by connecting the connection pipe to the internal pre-support member 4 so that an end part of the internal pre-support member 4 is partially exposed to be able to be connected to the plate type support member at the planned excavation surface of the main tunnel 2, after removing the connection pipe, a sack-packer is expanded by using the injection hose connected to the sack-packer, and pressurized-grouting of cement milk is conducted by using the injection hose bound to the side surface of the pre-support member while penetrating through the packer. A pressure of the pressurized-grouting is suitably 5 to 10 kg/cm$^2$, and if conducting the pressurized-grouting, the friction shear strength of the grouting bulb and the original ground is increased by about 3 times than in the case of gravity grouting, and an injection material is injected through a crack or a gap in the original ground, thereby exhibiting a waterproof effect.

The post-support member 5 is installed in such a manner that the internal pre-support member 4 is installed at the pilot tunnel, the main tunnel 2 is excavated, the shotcrete is primarily sprayed to the excavation surface of the main tunnel 2, holes for the rock bolt type post-support member 5 are drilled in the surface, a resin is put and the rock bolt is screwed in the hole while rotating the rock bolt to be fixed, and the bearing plate is fastened at a tip end thereof. In a case of the nail type post support member 5, after drilling a hole, a nail is inserted into the hole while having the injection hose 13 and the discharge hose bound thereto, and the packer 11 is expanded at a tip end thereof to conduct the pressurized-grouting using the cement milk. An effect of the injection is the same as that of the pre-support member.

A steel support member or a reinforcing steel cage 14 is fitted to a tip end of the post-support member 5 that is exposed for integration with the plate type support member 8, the bearing plate is put and compressed and fixed by tightening the anchorage, and then the shotcrete is sprayed so as to bury the anchorage, thereby integrating the post-support member 5 and the plate type support member of the tunnel excavation surface.

The plate type support member refers to the shotcrete deposited on the tunnel excavation surface and the reinforcing steel cage 14 reinforcing the inside. In the method of connecting the internal pre-support member 4 and the post-support member 5, the shotcrete is primarily sprayed to the excavation surface, the reinforcing steel cage 14 is fitted to the internal pre-support member 4 and the post-support member 5 that protrude on the shotcrete surface, the bearing plate is put and installed by tightening the anchorage, and the shotcrete is secondarily sprayed. The reinforcing steel cage has a width of 1 to 3 m, and is manufactured to match 1 lot excavation length in the longitudinal direction. a length in a transverse direction may be divided into two or three parts depending on stability of the ground, a spliceable steel rod is additionally extended to match the specification depending on a diameter of the steel rod for lap splice, the reinforcing steel cage of which an interval between upper and lower steel rods in the transverse direction is formed in a truss form is manufactured or the reinforcing steel cage is formed to have a mesh form to be disposed at a structurally required interval, and a distribution bar is welded in the longitudinal direction and upper and lower distribution bars are welded in a truss form by putting steel rods, thereby manufacturing the reinforcing steel cage as illustrated in FIG. 22.

If the ground is in a good state, the reinforcing steel cage 14 may be omitted or manufactured without division, and may be installed after excavating the entire cross section.

The excavating of the tunnel in stages along the excavation line of the main tunnel includes continuously installing the reinforcing steel cage 14 formed of a steel rod on the internal pre-support member 4 and the post-support member 5 after installing the post-support member 5 between the internal pre-support member 4 in the excavation surface, and putting the bearing plate on the internal pre-support member 4 penetrating through the reinforcing steel cage 14 and tightening the anchorage to compress and fix the reinforcing steel cage 14; and spraying the shotcrete to the reinforcing steel cage 14.

The tunneling method includes excavating the tunnel along an excavation line of the main tunnel 2 and installing a drainage member on the excavation surface; and spraying the shotcrete 8 to the excavation surface on which the drainage member 16 is installed.

The drainage member installed on the excavation surface needs to be continuously connected for drainage to dummy ditches buried at both side walls of the bottom of the tunnel. If the drainage member is installed as described above before spraying the shotcrete, it is possible to prevent efflorescence generated in the water passing through the shotcrete, thus the drain system may not be clogged. This may also be applied to a 2-arch tunnel or a general tunnel.

In a case in which there is a tall building foundation or a bridge foundation in the original ground close to the excavation surface of the main tunnel 2, thus displacement needs to be minimized, the construction is performed by the following processes: eccentrically disposing and excavating the pilot tunnel 3 in the main tunnel 2 so that a planned excavation surface of the main tunnel to which the obstruction 21 as described above is adjacent and the excavation surface of the pilot tunnel 3 are spaced apart from each other as much as possible and performing a support process to secure structural safety; installing the internal pre-support member 4 in the original ground 1 of the main tunnel 2 from the pilot tunnel 3 that is eccentrically installed; and installing the post-support member 5 between a plurality of internal pre-support members 4 after excavating the main tunnel 2.

An additionally excavated part in the bottom part 19 is to secure a drilling angle of a drilling machine at the time of the drilling operation.

In a state in which the pilot tunnel is eccentrically installed to minimize the displacement of the excavation surface of the main tunnel toward the obstruction generated due to the pilot tunnel, an internal pre-support member that has high elasticity and is thicker than an existing support member used for a general tunnel is installed to make the ground elastic, thereby decreasing displacement of the original ground and minimizing plastic relaxation, and by using the post-support member together, it is possible to decrease partial collapse.

A second embodiment of the present invention will be described in detail with reference to FIGS. 15 to 20.

A tunneling method includes installing external pre-support members 30 by drilling holes from a ground surface 31 toward a cross section and outer side parts of side walls of the cross section of a main tunnel 2 at a plurality of locations in advance before excavating the tunnel, inserting the pre-support members, and conducting grouting, if the pre-support member may be installed toward a planned cross section of the main tunnel at the outside of the tunnel by approaching the ground surface; excavating the tunnel in stages in a longitudinal direction along a planned excavation line of the main tunnel 2 and primarily spraying shotcrete to an excavation surface of the main tunnel in the main tunnel; and installing a post-support member between the plurality of external pre-support members in the excavation surface to which the shotcrete is sprayed in the tunnel.

In the above process, the post-support member 5 and the external pre-support members 30 are connected with the plate type support member to complete the tunnel.

A specific method of connecting with the plate type support member includes primarily spraying the shotcrete to the excavation surface, installing the post-support member 5 between the external pre-support members 4 in the excavation surface, connecting the external pre-support members 4 and the post-support member 5 on the shotcrete by the bearing plate, secondarily spraying the shotcrete on the installed bearing plate, installing a waterproof sheet, and installing a lining, thereby completing the tunnel.

As illustrated in FIG. 17, in the installing of the required number or more of external pre-support members 30 for standing-up of the excavation surface for an operation time when performing sequential excavation by a design excavation length of the tunnel at a plurality of locations from the ground surface 31 toward a cross section and outer side parts of the side walls of the cross section of the main tunnel 2 before the tunnel excavation, vertical side wall reinforcing external pre-support members 33 installed at outer sides of left and right side wall parts are installed deeper than a level of the bottom of the tunnel so as to prevent uplift of the bottom.

As illustrated in FIG. 18, in a case in which the external pre-support members are not sufficiently installed in the upper ground of the cross section of the main tunnel due to the obstruction, in the installing of the post-support member between the external pre-support members 30 in the tunnel, the post-support member is installed in the section in the unsupported state due to the obstruction.

As illustrated in FIG. 23, in the case in which the soil cover depth of the main tunnel is thin and the ground of the main tunnel is soft, the soil cover depth is replaced with an artificial reinforcement material 50 and the external pre-support member is installed from the replaced soil cover depth to the cross section of the tunnel and the outer side of the cross section of the tunnel. Specifically, the external pre-support members are inserted by drilling holes up to the original ground of the tunnel while penetrating through the artificial reinforcement material 50, cement milk is pressure-injected to integrate the original ground, the artificial reinforcement material 50, and the external pre-support member. The construction order may be changed so that the hole is first drilled in the original ground, the external pre-support member is inserted to be exposed, the cement milk is pressure-injected, and the artificial reinforcement material in installed thereon to integrate the artificial reinforcement material and the external pre-support member.

As the artificial reinforcement material 50, a material such as hardened soil in which silt of the original ground and the cement are mixed and tamped, concrete, ferroconcrete slab, etc. may be used, the soft property of the original ground of the ceiling part may be reinforced by replacement with a material having a high strength property, and by integration with the external pre-support member, structural stability of the tunnel may be secured.

When using high strength ferroconcrete slab in order to reinforce the soil cover depth of the tunnel, the tunnel may be excavated by replacing only as much as a thickness of slab of the ground surface, installing the external pre-support member, and ten preserving the soft original ground.

A method of connecting the plate type support member includes excavating a tunnel in stages in a longitudinal direction along an excavation line of a main tunnel, primarily spraying shotcrete, installing a post-support member 5 between a plurality of pre-support members, continuously installing a reinforcing steel cage formed of a steel rod on the pre-support member and the post-support member, and compressing and fixing the reinforcing steel cage by putting a bearing plate on the pre-support member penetrating through the reinforcing steel cage and tightening an anchorage; and spraying the shotcrete in the reinforcing steel cage, which is the same as in the first embodiment. Here, the excavation line refers to an outline of the cross section of the tunnel, and the shotcrete is sprayed to the excavation surface formed by excavating along the outline. The anchorage fixing the bearing plate has a nut form and is fitted to the pre-support member to be tightened.

The excavating the tunnel along an excavation line of the main tunnel and installing a drainage member on the excavation surface is the same as in the first embodiment.

The pre-support member and the post-support member are fixed to the original ground 1 of the main tunnel 2 by inserting the pre-support member after drilling a hole, and then conducting the pressurized-grouting to simultaneously generate supporting and waterproof effects, which is the same as in the first embodiment.

The first embodiment and the second embodiment are the same as each other in that in the method of manufacturing the reinforcing steel cage, the reinforcing steel cage is manufactured to have a width to match 1 lot excavation length in the longitudinal direction, a length in a transverse direction may be divided depending on stability of the ground, the divided parts are spliceable, the reinforcing steel cage is formed to have a mesh form, or the reinforcing steel cage of which an interval between upper and lower steel rods is formed in a truss form is disposed at a structurally required interval.

In order to construct a tunnel with improved economical efficiency without deteriorating advantages of the pre-support nail tunneling method according to the related art, according to the present invention, only some internal pre-support members are installed, rather than installing the internal pre-support members by a predetermined interval in the whole pilot tunnel, and sequential excavation is performed up to the excavation surface of the main tunnel and the post-support members such as a nail or a rock bolt are additionally installed in the drilled hole in the excavation surface of the main tunnel.

Accordingly, the installation of the post-support member is advantageous in that processes may be reduced as much as the length of the drilled hole from the pilot tunnel to the excavation surface of the main tunnel, and by installing a plurality of post-support members having a shorter length and a smaller diameter as compared to the internal pre-support member at the same construction cost, it is possible to efficiently prevent partial collapse even at the soft ground with many joints, and since the pre-support member and the post-support member more densely support shotcrete which is a plate type support member, it is possible to more completely constrain the excavation surface.

Further, in the large-section tunnel, if only the internal pre-support members are installed in the whole pilot tunnel for structural stability, since an interval between the drilled holes for installation of the pre-support member in a circumferential surface of the pilot tunnel is too narrow, the original ground close to the excavation surface of the pilot tunnel is excessively damaged by the drilled holes, thereby deteriorating stability of the pilot tunnel. However, according to the present invention, it is possible to solve the above problem by performing excavation up to the excavation surface of the main tunnel and then installing the post-support members between the internal pre-support members.

In terms of structural aspect, when excavating the main tunnel, since the stress applied to the original ground and linear type support members is largest at the excavation surface and is gradually decreased toward the outer side from the excavation surface, by installing the long internal pre-support members as illustrated in FIG. 3 and installing the short post-support members between the internal pre-support members together, it is possible to provide the most economical support form.

The pre-support member is designed to be longer than the post-support member to ensure structural stability of the whole tunnel and be made of a high strength material exhibiting high tensile force, and the minimum number or more of pre-support members required for standing-up for an operation time when performing sequential excavation to a design excavation length are used, and the post-support member is designed to have a small diameter and a short length to secure partial stability between the pre-support members to thereby additionally support the maximum stress at the excavation surface of the main tunnel. As a result, efficient stress distribution may be made.

In terms of installation cost of the pre-support member, the cost for drilling holes is much higher than that of nail materials, and a long drilling process time is required, thus at the time of installing the pre-support member, a thick and long nail having high rigidity is installed to minimize the number of pre-support members installed, and a plurality of post-support members that may be easily installed at the excavation surface when excavating the main tunnel and are cheap are installed, thereby implementing economical and easy installation.

In a case in which there is an obstruction around the tunnel, the pilot tunnel is eccentrically installed from the obstruction and an internal pre-support member that has high elasticity and is thicker than an existing support member used for a general tunnel is installed in the original ground of the main tunnel at the obstruction side from the pilot tunnel to make the ground elastic, thereby decreasing displacement of the original ground and minimizing plastic relaxation, and by using the post-support member together, it is possible to decrease partial collapse, and the unsupported state and displacement right after the excavation that are occur in the NATM according to the related art do not occur, thereby enabling safe construction.

In a case in which the ground around the side wall part of the tunnel is in a good state, since structural stability of the side wall mainly depends on compression strength, even when only the post-support member is installed, safety may be secured, and in a case of the soft ground such as the silt ground, the pre-support member and the post-support member are installed in the entire circumferential surface of the tunnel including a bottom part similarly to the ceiling part, thereby enabling economical and safe tunnel excavation.

In a case in which the soil cover depth is thin and in a case of a small-section tunnel, the post-support is more economical and a time required therefor is short as compared to the internal pre-support, thus may be applied to an entrance and an exit of the tunnel, urban railway, etc. The required number or more of external pre-support members for standing-up for an operation time when performing sequential excavation by a design excavation length are installed, rather than installing the whole quantity of support members required for stabilization of the tunnel at the outside of the tunnel, and the post-support member that is shorter and thinner than the pre-support member is additionally installed between the pre-support members in the tunnel to complete support of the tunnel, such that the number of external pre-support members installed may be decreased, thereby improving economical efficiency.

In the installing of the post-support member between the external pre-support members exposed to the excavation surface in the tunnel, only the post-support member is installed in the side wall part, that is, if the ground of the side wall part is in a good state, even when only the rock bolt is used in the tunnel, the sufficient support may be made, thereby implementing economic design.

In a case in which the external pre-support members are not sufficiently installed in the upper ground of the planned cross section of the tunnel due to an obstruction, in the installing of the post-support member between the external pre-support members exposed to the excavation surface in the tunnel, the post-support member is installed in the section in the unsupported state due to the obstruction, thereby overcoming the obstruction and implementing economic design.

As illustrated in FIG. 23, in the case in which the soil cover depth of the main tunnel is thin and the ground of the main tunnel is soft, it is possible to construct a tunnel even when the soil cover depth is shallow by replacing the soil cover depth with an artificial reinforcement material and installing the external pre-support member from the replaced soil cover depth to the cross section of the tunnel and the outer side of the cross section of the tunnel.

The installations methods of the internal post-support member, the shotcrete, the shotcrete reinforced with the thrust, and the drainage member in the external pre-supported tunnel are the same as those in the internal pre-supported tunnel, and effects thereof are also the same as each other.

When conducting a pressurized cement milk grouting using the injection hose bound to side surfaces of the pre-support member and the post-support member, a pressure of the pressurized-grouting may be 5 to 10 kg/cm$^2$, and if conducting the pressurized-grouting, the friction shear strength of the grouting bulb and the original ground is increased by about 3 times than in the case of gravity grouting, and the injection material is injected through a crack or a gap in the original ground, thereby increasing a waterproof effect and ground properties.

The reinforcing steel cage reinforcing the shotcrete which is a plate type support member and is installed on the excavation surface of the tunnel reduces a rebound amount of the shotcrete, and the rigidity may be increased through the reinforcement by the reinforcing steel cage buried in the shotcrete to increase the support ability of the plate type support member, thereby decreasing the number of post-support member.

When installing the reinforcing steel cage by fitting the reinforcing steel cage to the linear type support member and compressing using the bearing plate in the state of sealing with the shotcrete, the reinforcing steel cage may serve as a temporary support for unpredicted rock-falling at the excavation surface.

The drainage member installed in the excavation surface of the present method is continuously connected for drainage to the dummy ditches buried at both side walls of the bottom of the tunnel, and when the drainage member is installed as described above before spraying the shotcrete, it is possible to prevent efflorescence generated in the water passing through the shotcrete, thus the drain system may not be clogged, and this may also be applied to a 2-arch tunnel or a general tunnel.

INDUSTRIAL APPLICABILITY

The tunnel using the pre-support and the post-support according to the present invention may be constructed with improved economical efficiency, by installing only some internal pre-support members, rather than installing the internal pre-support members by a predetermined interval in the whole pilot tunnel, performing sequential excavation up to the excavation surface of the main tunnel, and additionally installing the post-support members such as a nail or a rock bolt by drilling the hole in the excavation surface of the main tunnel, thus industrial applicability is excellent.

1: original ground 2: main tunnel
3: pilot tunnel 4: internal pre-support member
5: post support member 6: main tunnel face
7: pilot tunnel face
8: plate type support member (shotcrete)
9: lining 10: stopper
11: packer 12: connection pipe
13: injection hose 14: reinforcing steel cage
15: bearing plate 16: drainage member
17: ceiling part 18: side wall part
19: bottom part 21: obstruction
30: external pre-support member
31: ground surface
32: inclined side wall reinforcing external pre-support member
33: vertical side wall reinforcing external pre-support member -continued 34: radial direction external pre-support member
40: tunnel face 50: artificial reinforcement material

What is claimed is:

1. A tunneling method using an internal pre-support member and a post-support member, the tunneling method comprising the steps of:

(a) excavating a pilot tunnel in a main tunnel to be constructed;

(b) radially forming a drilled hole from an excavation surface of the pilot tunnel to a tip end of the internal pre-support member of the main tunnel at a plurality of locations in the pilot tunnel to install the internal pre-support member;

(c) inserting the internal pre-support member into the drilled hole, (d) grouting and curing to fix the internal pre-support member;

(e) excavating the main tunnel in stages in a longitudinal direction along an excavation line of the main tunnel and primarily spraying shotcrete to an excavation surface of the main tunnel;

(f) drilling a hole for receiving the post-support member on the excavation surface of the main tunnel to which the shotcrete is primarily sprayed;

(g) installing the post-support member at the hole between a plurality of the internal pre-support members on the excavation surface of the main tunnel to which the shotcrete is primarily sprayed;

(h) fixing the post support member using grout to completely fill a space between the hole and the post support member for bonding the post support member to the hole such that an existing structure of the main tunnel is reinforced; and (i) connecting the internal pre-support member and the post-support member with a plate type support member, wherein a length or a diameter of the pre-support member is larger than a length or a diameter of the post-support member and wherein the post support member comprises at least one of a steel rod, a hollowed rock bolt, a steel pipe, a perforated steel pipe, a glass fiber reinforced plastic (GRP) bolt, or a swell bolt.

2. The tunneling method of claim 1, wherein at the time of step (g), the post-support member is installed between the internal pre-support members located on a ceiling surface of the main tunnel, and wherein only the post-support member is installed on a side wall surface of the main tunnel.

3. The tunneling method of claim 1, wherein the internal pre-support member is configured with:

a stopper for preventing slip in the drilled hole;

a discharge hose and an injection hose coupled to a side surface of the internal pre-support member;

a packer for pressurized-grouting mounted at a tip end of the internal pre-support member; and a connection pipe coupled to and detachable from a body of the internal pre-support member for inserting the body of the pre-support member into the drilled hole of the main tunnel.

4. The tunneling method of claim 1, wherein the step (g) further comprises the step of (g') comprising:

continuously installing a reinforcing steel cage formed of a steel rod on the internal pre-support member and the post-support member;

putting a bearing plate on the internal pre-support member penetrating through the reinforcing steel cage;

tightening an anchorage to compress and fix the reinforcing steel cage; and spraying the shotcrete to the reinforcing steel cage.

5. The tunneling method of claim 4, wherein the reinforcing steel cage is manufactured in a mesh form, or an interval between upper and lower steel rods is formed in a truss form.

6. The tunneling method of claim 1, further comprising:

excavating along an excavation line of the main tunnel and installing a drainage member on the excavation surface of the main tunnel; and primarily spraying the shotcrete to the excavation surface of the main tunnel after installing the drainage member.

7. The tunneling method of claim 1, wherein the internal pre-support member is fixed to the drilled hole of the main tunnel by injecting a gout material to fill a space between the drilled hole and pre-support member placed in the hole for preserving integrity of structure near the main tunnel location or a ground surface upon the main tunnel.

8. A tunneling method using an external pre-support member and a post-support member, the tunneling method comprising the steps of:

(a) installing the external pre-support member by drilling holes from a ground surface toward an outer surface of a section to be excavated of a main tunnel, inserting the external pre-support member into the drilled holes, and grouting the external pre-support member to the drilled holes, (b) excavating the main tunnel in stages in a longitudinal direction along a planned excavation line of the main tunnel and primarily spraying shotcrete to an excavation surface of the main tunnel;

(c) drilling a hole for receiving the post-support member on the surface of the main tunnel to which the shotcrete is primarily sprayed;

(d) installing the post-support member at the hole between a plurality of the external pre-support members in the excavation surface of the main tunnel to which the shotcrete is primarily sprayed in the main tunnel;

(e) is fixing the post support member using grout to completely fill a space between the hole and the post support member for bonding the post support member to the hole such that an existing structure of the main tunnel is reinforced; and (f) connecting the external pre-support member and the post-support member with a plate type support member, wherein a length or a diameter of the pre-support member is larger than a length or a diameter of the external post-support member and wherein the post support member comprises at least one of a steel rod, a hollowed rock, a steel pipe, a perforated steel pipe, a glass fiber reinforced plastic (GRP) bolt, or a swell bolt.

9. The tunneling method of claim 8, wherein at the time of step (a), the external pre-support members, spaced apart from an outer surface of the section to be excavated of the main tunnel, are inserted at a depth deeper than a bottom surface of the main tunnel so as to prevent uplift of the bottom surface.

10. The tunneling method of claim 8, wherein an artificial reinforcement material is placed on a soil cover located on the top of the main tunnel for reinforcing a ground structure beneath the soil cover and;

wherein the external pre-support member is installed from the reinforced soil cover toward an outer section of the section to be excavated of the main tunnel in one direction.

11. The tunneling method of claim 8, wherein the step (d) further comprises the step of (d') comprising:

continuously installing a reinforcing steel cage formed of a steel rod on the external pre-support member and the post-support member;

putting a bearing plate on the external pre-support member penetrating through the reinforcing steel cage;

tightening an anchorage to compress and fix the reinforcing steel cage; and spraying the shotcrete to the reinforcing steel cage.

12. The tunneling method of claim 8, further comprising:

excavating along an excavation line of the main tunnel and installing a drainage member on the excavation surface of the main tunnel; and primarily spraying the shotcrete to the excavation surface of the main tunnel after installing the drainage member.

13. The tunneling method of claim 8, wherein the external pre-support member is fixed to the drilled hole of the main tunnel by injecting a grout material to fill a space between the drilled hole and the external pre-support member placed in the hole for preserving integrity of structure near the main tunnel location or on a ground surface upon the main tunnel.

* * * * *